US011766381B2

(12) United States Patent
Marton et al.

(10) Patent No.: US 11,766,381 B2
(45) **Date of Patent: *Sep. 26, 2023**

(54) MOTOR AND PISTON ASSEMBLY FOR PERCUSSIVE MASSAGE DEVICE

(71) Applicant: Hyperice IP SubCo, LLC, Irvine, CA (US)

(72) Inventors: Robert Marton, Yorba Linda, CA (US); Anthony Katz, Laguna Niguel, CA (US)

(73) Assignee: Hyperice IP SubCo, LLC, Irvine, CA (US)

( * ) Notice: Subject to any disclaimer, the term of this patent is extended or adjusted under 35 U.S.C. 154(b) by 369 days.

This patent is subject to a terminal disclaimer.

(21) Appl. No.: 17/206,530

(22) Filed: Mar. 19, 2021

(65) Prior Publication Data

US 2022/0133585 A1 May 5, 2022

Related U.S. Application Data

(63) Continuation of application No. 17/090,864, filed on Nov. 5, 2020, now Pat. No. 10,993,874.

(51) Int. Cl.
*A61H 23/00* (2006.01)
*A61H 23/02* (2006.01)

(52) U.S. Cl.
CPC ..... *A61H 23/006* (2013.01); *A61H 23/02* (2013.01); *A61H 23/008* (2013.01);
(Continued)

(58) Field of Classification Search
CPC ..... A61H 23/006; A61H 23/02; A61H 2201/1454; A61H 23/00; A61H 23/008;
(Continued)

(56) References Cited

U.S. PATENT DOCUMENTS 4,088,128 A * 5/1978 Mabuchi ..... A61H 23/0254 601/108
4,513,737 A * 4/1985 Mabuchi ..... A61H 23/0254 601/108

(Continued)

FOREIGN PATENT DOCUMENTS

CN 2694966 Y 4/2005
CN 202536467 U 11/2012

(Continued)

OTHER PUBLICATIONS

Office Action dated Jun. 21, 2022 for corresponding Taiwan Patent Application No. 110141368.

(Continued)

*Primary Examiner* — Justine R Yu
*Assistant Examiner* — Benjamin M. Kusiak
(74) *Attorney, Agent, or Firm* — Patterson Intellectual Property Law, P.C.; Jerry Turner Sewell

(57) ABSTRACT

A self-contained reciprocation mechanism is coupleable within an enclosure of a percussive massage device and is configured to receive an applicator head for stimulating a user's muscles. The self-contained reciprocation mechanism includes a spatial positioning bracket, a semi-cylindrical bracket, a piston, a motor, a crank, and a reciprocation linkage. The spatial positioning bracket is configured to receive the other interconnected components of the self-contained reciprocation mechanism and position said components relative to each other at close predetermined tolerances to assure that the interconnected components are properly positioned to provide consistent operating characteristics. The self-contained reciprocation mechanism is coupled within the enclosure using screws which extend through mounting tabs of the spatial positioning bracket.

20 Claims, 12 Drawing Sheets

(52) U.S. Cl.
CPC ..... *A61H 2201/0153* (2013.01); *A61H 2201/0157* (2013.01); *A61H 2201/0165* (2013.01); *A61H 2201/1454* (2013.01); *A61H 2201/1664* (2013.01); *A61H 2201/1669* (2013.01); *A61H 2201/5035* (2013.01)

(58) Field of Classification Search
CPC ..... A61H 23/0254; A61H 2201/0153; A61H 2201/0157; A61H 2201/0165; A61H 2201/1207; A61H 2201/1215; A61H 2201/1664; A61H 2201/1669; A61H 2201/1685; A61H 2201/5035; A61B 50/00; B23D 49/007; B23D 49/008; B23D 49/10; B23D 49/16; B23D 49/162; B23D 49/165; B23D 49/167; B23D 51/01; B23D 51/02; B23D 51/025; B23D 51/08; B23D 51/10; B23D 51/16; B23D 51/163; B23D 51/166; B27B 19/00; B27B 19/002; B27B 19/004; B27B 19/006; B27B 19/008; B27B 19/09
USPC ..... 601/107, 108, 111; 30/392–394
See application file for complete search history.

(56) References Cited

U.S. PATENT DOCUMENTS

| | | | | |
|---|---|---|---|---|
| 4,549,535 | A | 10/1985 | Wing | |
| 4,726,430 | A | 2/1988 | Hendrikx et al. | |
| 4,790,296 | A | 12/1988 | Segal | |
| 4,841,955 | A | 6/1989 | Evans et al. | |
| 5,656,017 | A | 8/1997 | Keller et al. | |
| 6,228,042 | B1 | 5/2001 | Dungan | |
| 6,616,621 | B1 | 9/2003 | Kohr | |
| 6,682,496 | B1 * | 1/2004 | Pivaroff | A61H 7/005 601/107 |
| 8,826,547 | B2 | 9/2014 | Oberheim | |
| 9,889,066 | B2 | 2/2018 | Danby et al. | |
| 10,314,762 | B1 * | 6/2019 | Marton | A61H 23/006 |
| 10,357,425 | B2 | 7/2019 | Wersland et al. | |
| 10,492,984 | B2 | 12/2019 | Marton et al. | |
| 10,561,574 | B1 | 2/2020 | Marton et al. | |
| 10,702,448 | B2 | 7/2020 | Wersland et al. | |
| 10,993,874 | B1 | 5/2021 | Marton et al. | |
| 2006/0293711 | A1 | 12/2006 | Keller et al. | |
| 2009/0270915 | A1 * | 10/2009 | Tsai | A61H 1/008 606/238 |
| 2014/0031866 | A1 | 1/2014 | Fuhr et al. | |
| 2015/0005682 | A1 | 1/2015 | Danby et al. | |
| 2015/0107383 | A1 | 4/2015 | Duesselberg et al. | |
| 2015/0182415 | A1 | 7/2015 | Olkowski et al. | |
| 2016/0354277 | A1 | 12/2016 | Fima | |
| 2018/0008512 | A1 | 1/2018 | Goldstein | |
| 2018/0168913 | A1 | 6/2018 | Sedic | |
| 2018/0200141 | A1 | 7/2018 | Wersland et al. | |
| 2018/0263845 | A1 | 9/2018 | Wersland et al. | |
| 2019/0209424 | A1 | 7/2019 | Wersland et al. | |
| 2019/0254921 | A1 * | 8/2019 | Marton | A61H 23/0254 |
| 2020/0261307 | A1 | 8/2020 | Wersland et al. | |
| 2020/0261310 | A1 | 8/2020 | Wersland et al. | |
| 2020/0276079 | A1 * | 9/2020 | Cheng | A61H 23/0263 |
| 2020/0289365 | A1 | 9/2020 | Wersland et al. | |
| 2020/0330321 | A1 | 10/2020 | Wersland et al. | |
| 2020/0352820 | A1 | 11/2020 | Nazarian et al. | |
| 2020/0352821 | A1 | 11/2020 | Wersland et al. | |
| 2020/0405574 | A1 * | 12/2020 | Wersland | A61H 1/008 |

FOREIGN PATENT DOCUMENTS

| | | | |
|---|---|---|---|
| CN | 206381369 | U | 8/2017 |
| CN | 205268525 | U | 6/2018 |
| CN | 208130157 | U | 11/2018 |
| CN | 210301676 | U | 4/2020 |
| JP | D1683409 | | 4/2021 |
| KR | 200311328 | Y1 | 5/2003 |
| KR | 3010427980000 | | 1/2020 |
| KR | 102078829 | B1 | 2/2020 |
| TW | M543692 | U | 6/2017 |
| TW | D202371 | | 1/2020 |
| TW | 202017550 | A | 5/2020 |
| TW | M599159 | U | 8/2020 |
| WO | 2012177028 | A2 | 12/2012 |

OTHER PUBLICATIONS

IPO Search Report dated Jun. 21, 2022 for corresponding Taiwan Patent Application No. 110141368.
English Translation of Office Action and Search Report for corresponding Taiwan Patent Application No. 110141368.
International Search Report and Written Opinion for PCT application No. PCT/US2021/057717, dated Feb. 23, 2022, 9 pages.
Taiwan IPO Search Report for corresponding Taiwan Design Patent Application No. 110300550, completed on May 27, 2021, 1 page.
English translation of Taiwan IPO Search Report for corresponding Taiwan Design Patent Application No. 110300550, completed on May 27, 2021, 1 page.

* cited by examiner

MOTOR AND PISTON ASSEMBLY FOR PERCUSSIVE MASSAGE DEVICE

RELATED APPLICATIONS

This application is a continuation of U.S. patent application Ser. No. 17/090,864, filed on Nov. 5, 2020, for "Motor and Piston Assembly for Percussive Massage Device," which is incorporated herein in its entirety.

FIELD OF THE INVENTION

The present invention is in the field of therapeutic devices, and, more particularly, is in the field of devices that apply percussive massage to selected portions of a body.

BACKGROUND OF THE INVENTION

Percussive massage, which is also referred to as tapotement, is the rapid, percussive tapping, slapping and cupping of an area of the human body. Percussive massage is used to more aggressively work and strengthen deep-tissue muscles. Percussive massage increases local blood circulation and can even help tone muscle areas. Percussive massage may be applied by a skilled massage therapist using rapid hand movements; however, the manual force applied to the body varies, and the massage therapist may tire before completing a sufficient treatment regime.

Percussive massage may also be applied by electromechanical percussive massage devices (percussive applicators), which are commercially available. Such percussive applicators may include, for example, an electric motor coupled to drive a reciprocating piston within a cylinder. A variety of percussive heads may be attached to the piston to provide different percussive effects on selected areas of the body. In known percussive massage devices, the electric motor, the cylinder and the piston are mounted into an outer body structure and interconnected as part of the final manufacturing process. The outer body structure includes mounting structures for each component that are positioned with close tolerances to assure that the interconnected components are properly positioned to provide consistent operating characteristics. Decreasing the size of the percussive massage device causes difficulties in providing the mounting structures with the desired close tolerances in the positioning of the structures.

SUMMARY OF THE INVENTION

A need exists for an electromechanical percussive massage device having an integral reciprocation assembly that includes a motor, a cylinder and a piston such that the reciprocation assembly can be assembled as a unit with the positional relationships of the components fixed. The assembled reciprocation assembly can then be installed in an outer body structure as a single unit.

One aspect of the embodiments disclosed herein is a self-contained reciprocation mechanism that is coupleable within an enclosure of a percussive massage device and is configured to receive an applicator head for stimulating a user's muscles. The self-contained reciprocation mechanism includes a spatial positioning bracket, a semi-cylindrical bracket, a piston, a motor, a crank, and a reciprocation linkage. The spatial positioning bracket is configured to receive the other interconnected components of the self-contained reciprocation mechanism and position said components relative to each other at close predetermined tolerances to assure that the interconnected components are properly positioned to provide consistent operating characteristics. The self-contained reciprocation mechanism is coupled within the enclosure using screws which extend through mounting tabs of the spatial positioning bracket.

Another aspect of the embodiments disclosed herein is a self-contained reciprocation mechanism coupleable within an enclosure of a percussive massage device and configured to receive an applicator head. The self-contained reciprocation mechanism comprises a spatial positioning bracket, a semi-cylindrical bracket, a piston, a motor, a crank, and a reciprocation linkage. The spatial positioning bracket includes a motor mounting portion, a downwardly open semi-cylindrical end portion, and a downwardly open partially cylindrical middle portion positioned between the motor mounting portion and the semi-cylindrical end portion. The semi-cylindrical end portion and the partially cylindrical middle portion extend along a longitudinal direction. The semi-cylindrical bracket is coupleable to the semi-cylindrical end portion of the spatial positioning bracket to define a cylindrical passageway along the longitudinal direction. The piston is slidably positioned within the cylindrical passageway. The piston has a first piston end and a second piston end. The piston is constrained to move only along the longitudinal direction through the cylindrical passageway. The second piston end is configured to receive the applicator head. The motor is coupled to the motor mounting portion of the spatial positioning bracket. The motor includes a rotatable shaft extending below the motor mounting portion. The shaft has a central axis oriented perpendicular to the longitudinal direction. The crank includes a central bore configured to receive the shaft of the motor such that the crank is positioned below the motor mounting portion of the spatial positioning bracket. The crank further includes a downwardly extending post offset from the central axis of the shaft. The reciprocation linkage has a first linkage end and a second linkage end. The first linkage end is coupled to post of the crank, and the second linkage end is coupled to the first piston end.

Another aspect in accordance with embodiments disclosed herein is a battery-powered percussive massage applicator comprising a main enclosure, a reciprocation unit, and an applicator head. The main enclosure includes a first enclosure portion coupleable to a second enclosure portion. The main enclosure includes a cavity defined between the first and second enclosure portions. The cavity extends along a longitudinal direction and includes a front opening. The reciprocation unit is coupleable to one of the first enclosure portion or the second enclosure portion within the cavity. The reciprocation unit comprises a spatial positioning bracket, a semi-cylindrical bracket, a piston, a motor, a crank, and a reciprocation linkage. The spatial positioning bracket includes a motor mounting portion, a semi-cylindrical end portion, and a middle portion positioned between the motor mounting portion and the semi-cylindrical end portion. The semi-cylindrical end portion and the middle portion extend along the longitudinal direction. The semi-cylindrical bracket is coupleable to the semi-cylindrical end portion of the spatial positioning bracket to define a cylindrical passageway along the longitudinal direction. The piston is slidably positioned within the cylindrical passageway. The piston has a first piston end and a second piston end. The piston is constrained to move only along the longitudinal direction through the cylindrical passageway. The motor is coupled to the motor mounting portion of the spatial positioning bracket. The motor includes a rotatable shaft extending through a central hole of the motor mounting portion. The shaft has a central axis oriented perpendicular to the longitudinal direction. The crank is coupled to the shaft of the motor and includes a post offset from and parallel to the central axis of the shaft. The post extends away from the motor mounting portion of the spatial positioning bracket. The reciprocation linkage has a first linkage end and a second linkage end. The first linkage end is coupled to post of the crank, and the second linkage end is coupled to the first piston end. The applicator head has a first applicator end and a second applicator end. The first applicator end of the applicator head is coupled to the second piston end of the piston. The second applicator end of the applicator head is exposed outside the cavity of the main enclosure.

BRIEF DESCRIPTIONS OF THE DRAWINGS

The foregoing aspects and other aspects of the disclosure are described in detail below in connection with the accompanying drawings in which.

DESCRIPTION OF ILLUSTRATED EMBODIMENTS

Figure 1:
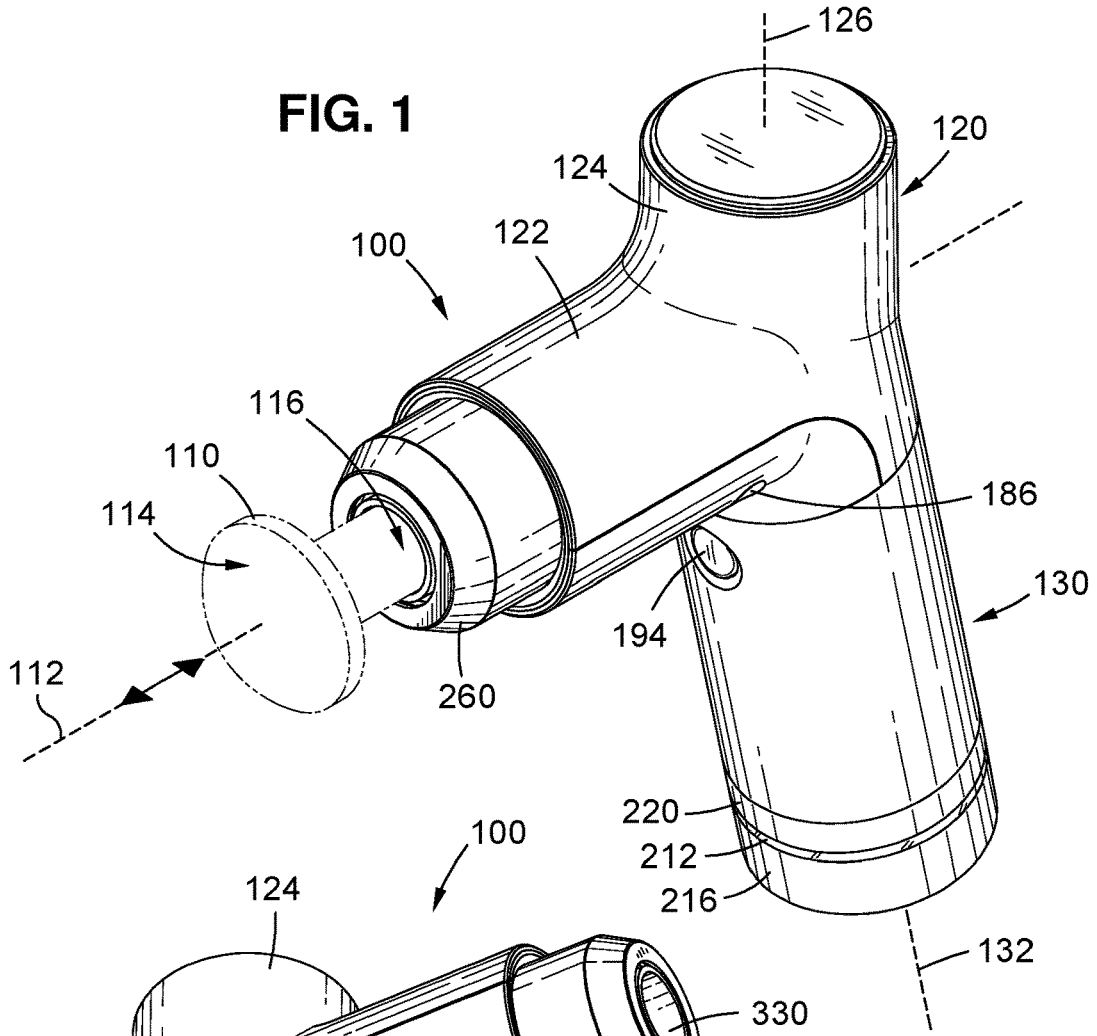
FIG. 1 illustrates a distal, top perspective view of a portable electromechanical percussive massage applicator with a removable massage head (shown in phantom lines) attached to the piston at the distal end of the applicator.

As used throughout this specification, the words "upper," "lower," "longitudinal," "upward," "downward," "proximal," "distal," and other similar directional words are used with respect to the views being described. It should be understood that the percussive massage applicator described herein can be used in various orientations and is not limited to use in the orientations illustrated in the drawing figures.

Figure 5:
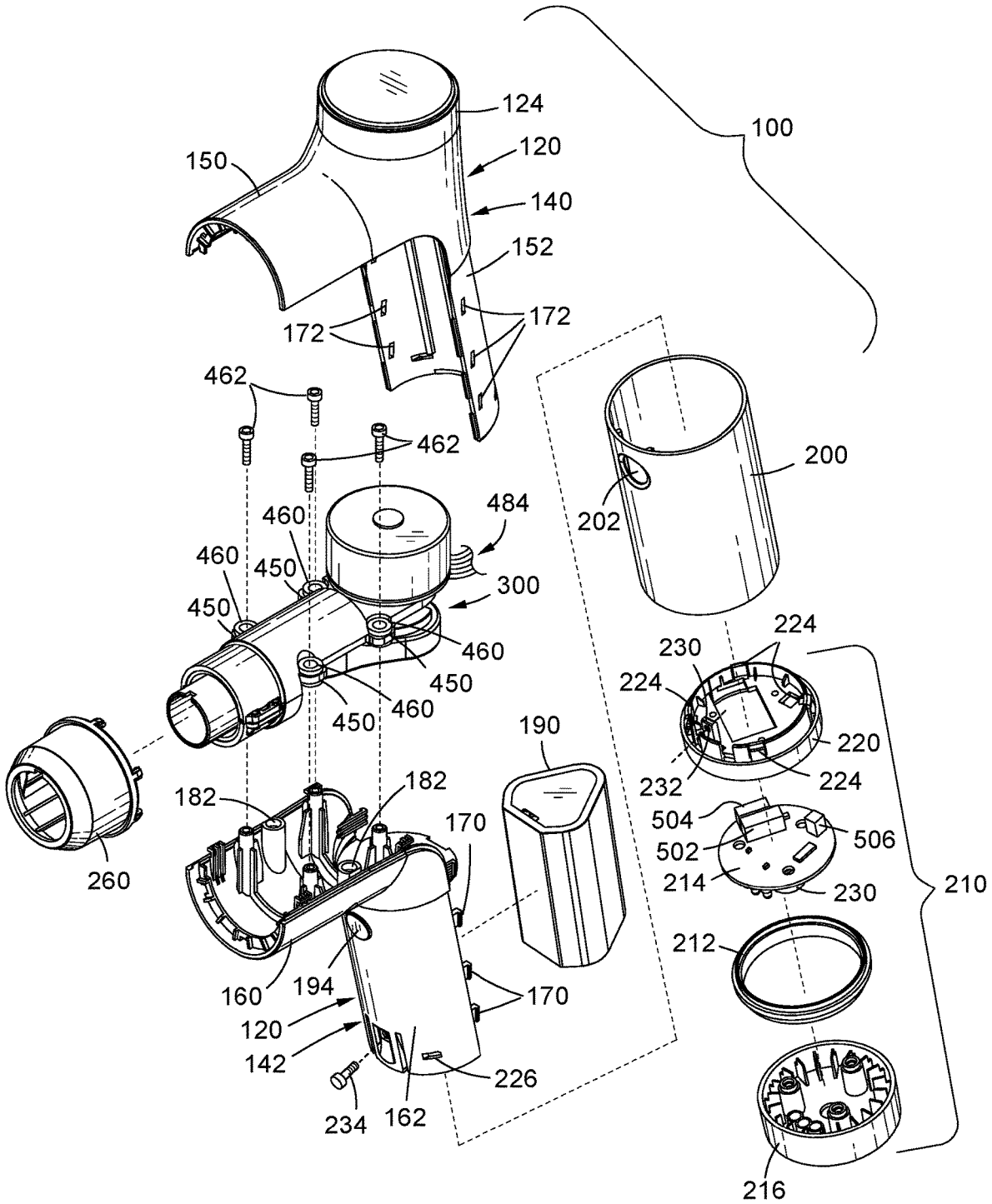
FIG. 5 illustrates an exploded distal, top perspective view of the portable electromechanical percussive massage applicator of FIG. 1 showing the assembled reciprocation mechanism prior to attachment to the outer body structure.
Figure 6:
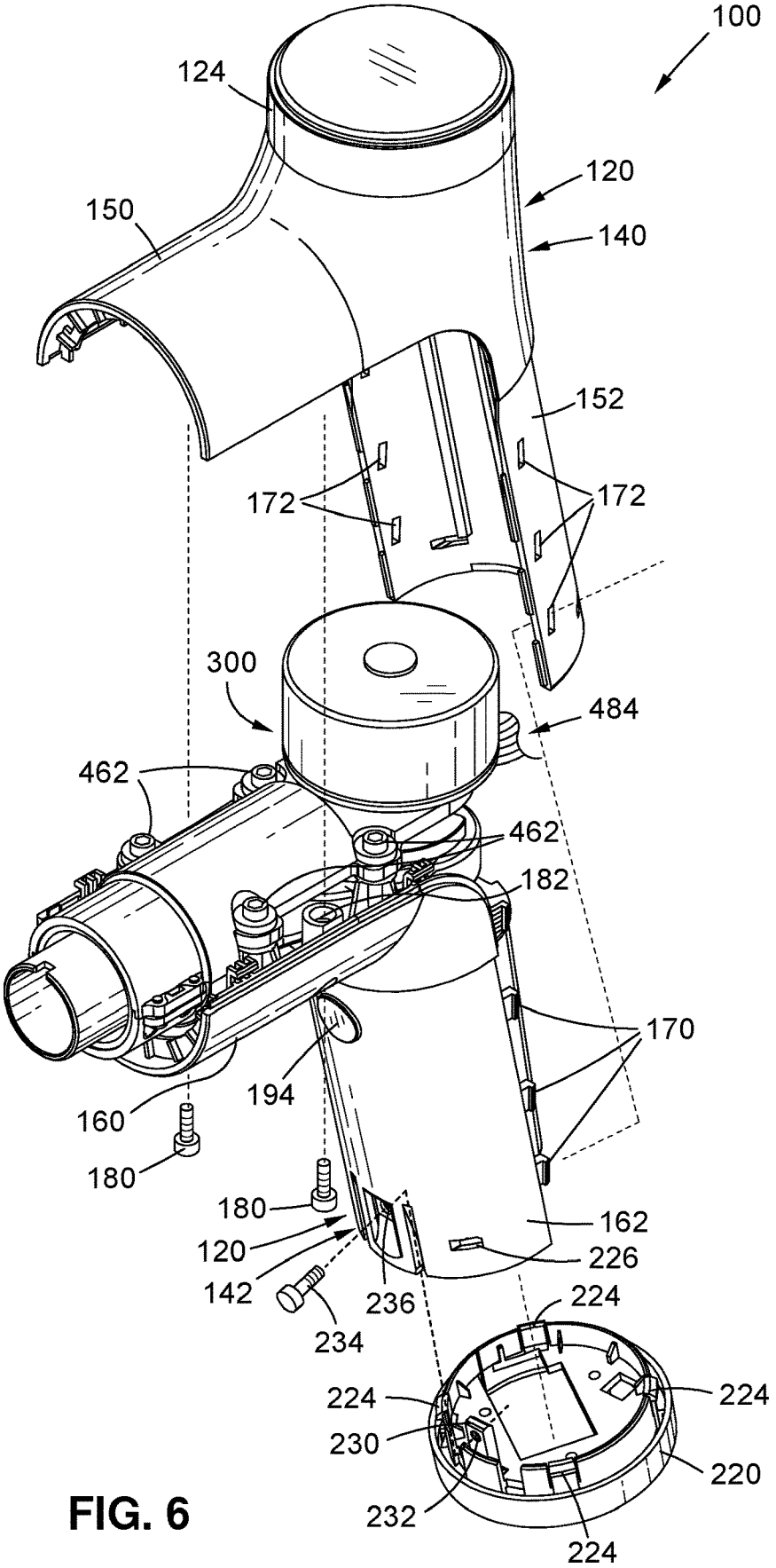
FIG. 6 illustrates a partially exploded distal, top perspective view of the potable electromechanical percussive massage applicator of FIG. 1 showing the assembled reciprocation mechanism attached to the outer body structure.
Figure 7:
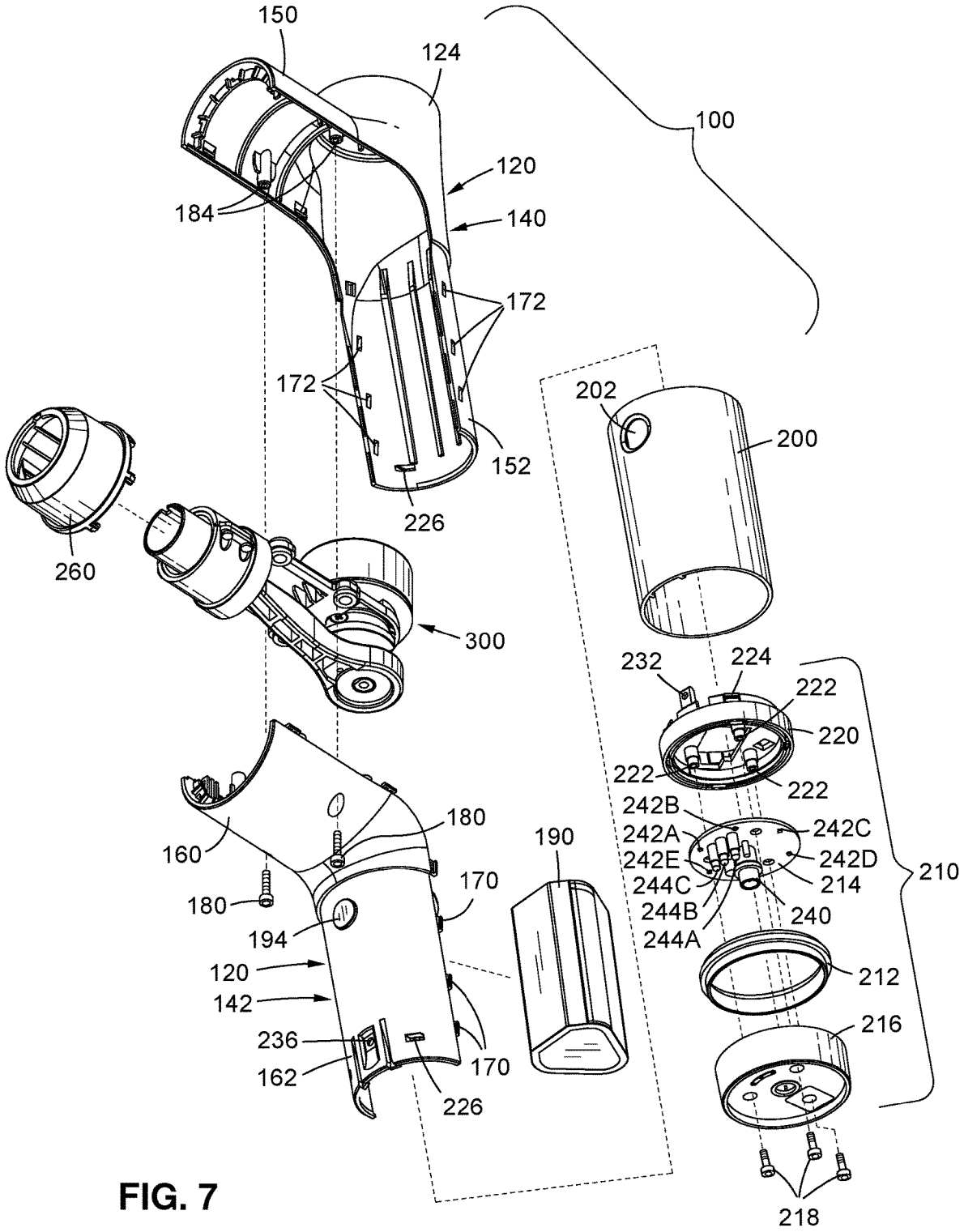
FIG. 7 illustrates an exploded distal, bottom perspective view of the portable electromechanical percussive massage applicator of FIG. 1 showing the assembled reciprocation mechanism prior to attachment to the outer body structure.

FIGS. 1-4 illustrate external views of a portable electromechanical percussive massage applicator ("percussive massage applicator" or "percussive massage device") 100. FIGS. 5-7 illustrate exploded views of the percussive massage applicator. The percussive massage applicator is operable with a removably attachable applicator head 110 (shown in phantom in FIG. 1). The applicator head includes a first applicator end 114 and a second applicator end 116. The applicator head, specifically the second applicator end, extends distally from a distal portion of the applicator. As used herein, "distal" refers to the portion of the percussive massage device nearest the applicator head, and "proximal" refers to the portion of the percussive massage device farthest from the applicator head. As described below, the applicator head reciprocates along a reciprocation axis 112 to cause the applicator head to rhythmically apply percussive massage when the applicator head, specifically the first applicator end, is applied against the skin of a person. The percussive massage applicator can be used by a massage therapist or other person to apply percussive massage to another person. The percussive massage applicator can also be used by the recipient of the massage therapy. The size and weight of the percussive massage applicator along with the cylindrical handle allow the percussive massage applicator to be self-applied to most muscles of a person's body.

The percussive massage applicator 100 includes a main enclosure 120. A distal cylindrical portion 122 of the main enclosure extends along the reciprocation axis 112. A motor enclosure portion 124 extends upwardly from a proximal portion of the main enclosure. In the illustrated embodiment, the motor enclosure portion extends along a motor axis 126 that is perpendicular to the reciprocation axis. A handle 130 extends downwardly from the proximal portion of the main enclosure. The handle extends along a handle axis 132. In the illustrated embodiment, the handle axis is oriented at a slant angle of approximately 12 degrees with respect to the motor axis.

In the illustrated embodiment, the main enclosure 120 comprises a first (upper) enclosure portion 140 and a second (lower) enclosure portion 142 as shown in FIGS. 5-7.

The first enclosure portion 140 includes a distal upper semicylindrical portion 150 that forms an upper half of the distal cylindrical portion 122 of the main enclosure 120. An upper portion of a proximal end of the first enclosure portion comprises the motor enclosure portion 124. A lower portion of the proximal end of first enclosure portion includes a first semicylindrical handle portion 152 that extends downwardly below the motor enclosure portion along the handle axis 132. In the illustrated embodiment, the first enclosure portion is formed as a single integral unit from a suitable material such as plastic. For example, the first enclosure portion may be injection molded.

The second enclosure portion 142 includes a distal lower semicylindrical portion 160 that forms a lower half of the distal cylindrical portion 122 of the main enclosure 120. The second enclosure portion further includes a second semicylindrical handle portion 162 that extends downwardly from the distal lower semicylindrical portion along the handle axis 132. In the illustrated embodiment, the second enclosure portion is formed as a single integral unit from a suitable material such as plastic. For example, the second enclosure portion may be injection molded.

As shown in FIGS. 1-4, when the first enclosure portion 140 and the second enclosure portion 142 are engaged, the distal upper semicylindrical portion 150 and the distal lower semicylindrical portion 160 engage to form the distal cylindrical portion 122. The first semicylindrical handle portion 152 and the second semicylindrical handle portion 162 also engage to form the handle 130. In the illustrated embodiment, the second semicylindrical handle portion includes a plurality of tabs 170 (e.g., eight tabs) that engage a plurality of corresponding slots 172 on the first semicylindrical handle portion. Each edge of the semicylindrical handle portion may include four tabs and four slots as shown in FIGS. 5-7.

As shown in FIGS. 5-7, the first and second enclosure portions 140, 142 are further secured by a pair of enclosure engagement screws 180 that pass through a pair of through bores 182 in the distal lower semicylindrical portion 160 and engage a pair of bores 184 in the distal upper semicylindrical portion 150. The heads of the body engagement screws are covered by a pair of screwhead covers 186 (only one shown in each of FIGS. 1-3). Accordingly, the first and second enclosure portions are easily interconnected to form the main enclosure 120.

Figure 10:
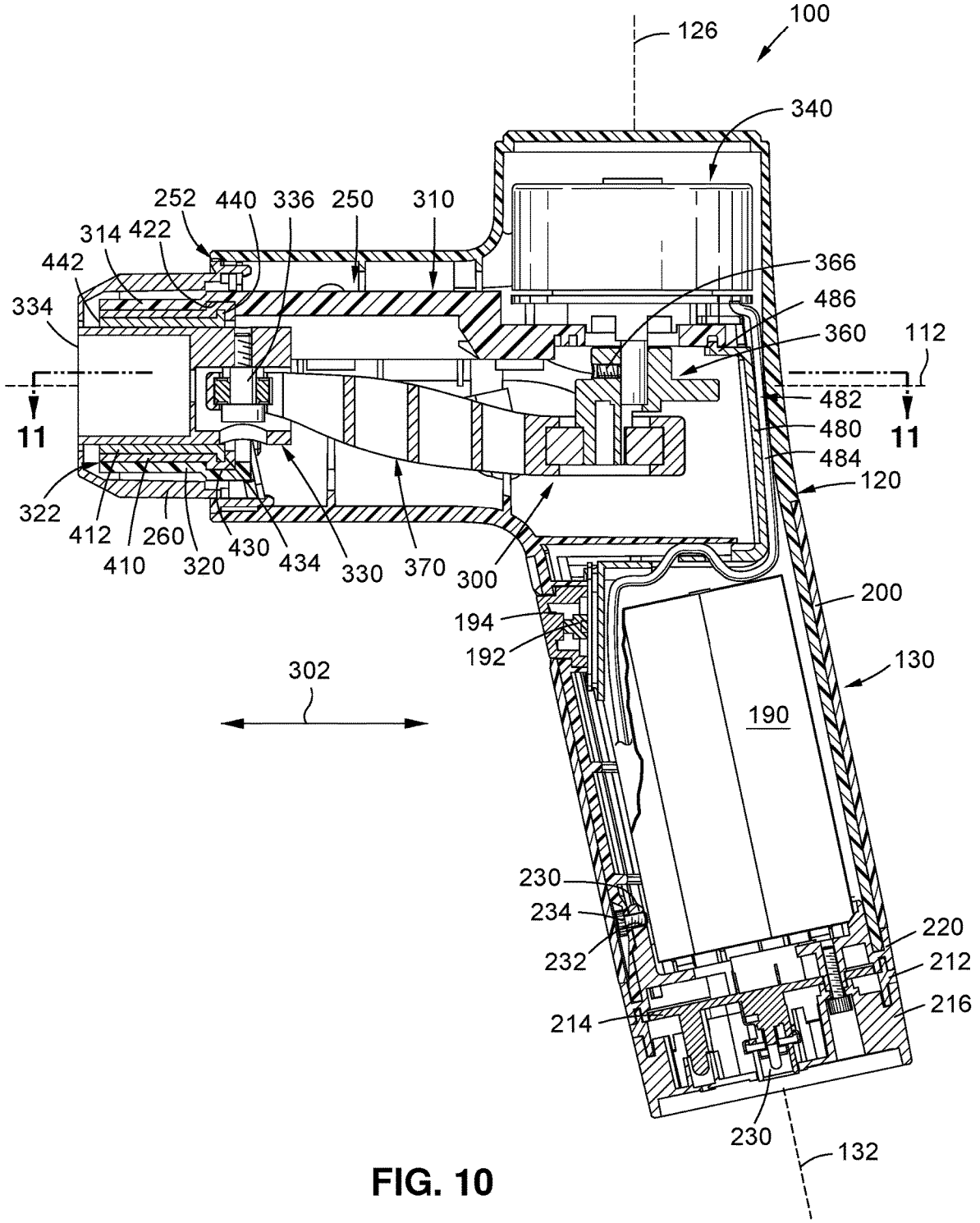
FIG. 10 illustrates a cross-sectional elevational view of the portable electromechanical percussive massage applicator of FIG. 1 taken along the line 10-10 in FIG. 4.

Prior to engaging the first enclosure portion 140 and the second enclosure portion 142, a battery 190 is installed in the handle 130 as shown in the cross-sectional view in FIGS. 5, 7, and 10. The battery is electrically connected to other components within the percussive massage device by suitable interconnections such as wires and connectors in a conventional manner. The battery may be secured within the handle by cushioning material (e.g., foam) that fills the inside of the handle.

The operation of the percussive massage applicator 100 is controlled by a switch 192 (FIG. 10), which has a switch cover 194 that extends through an upper portion of the second semicylindrical handle portion 162.

A gripping sleeve 200 is secured over the cylindrical battery/handle. In the illustrated embodiment, the gripping sleeve comprised a rubber material such as neoprene. The gripping sleeve includes an opening 202 that provides access to the switch cover 194 to allow a user to activate the switch 192.

The percussive massager applicator 100 further includes an end cap assembly 210 coupled to lower ends of the first cylindrical handle portion 152 and the second semicylindrical handle portion 162. The end cap assembly includes at least a light ring 212, a printed circuit board (PCB) 214, an end cap 216 and a handle attachment section 220, which are coupled together as shown in FIGS. 5, 7 and 10. Three end cap screws 218 pass through the end cap, through the PCB and through the light ring to engage bores 222 (shown in FIG. 7) of the handle attachment section.

The handle attachment section 220 includes a plurality of tabs 224 (e.g., four tabs) configured to secure the end cap assembly 210 to the handle 130 via a corresponding plurality of slots 226 positioned near the lower ends of the first and second semicylindrical handle portions 152, 162. As shown in FIGS. 5 and 10, the handle attachment section further includes an extrusion 230 for securely attaching the handle attachment section to the lower ends of the first and second semicylindrical handle portions. The extrusion includes a bore hole 232 for receiving a screw 234 via a through bore 236 in the second semicylindrical handle portion 162.

The PCB 214 is electrically connected to a power adaptor connector 240, which passes through the end cap 216. The PCB receives electrical power from a power adaptor (not shown) when the power adaptor is plugged into the power adaptor connector and into a source (not shown) of AC power. The PCB supports electronic components and interconnections for a battery monitoring and charging circuit that monitors the charge of the battery 190 and that selectively charges the battery when the power adaptor is active and is plugged into the power adapter connector. As shown in FIG. 7, the PCB further supports a plurality of light-emitting diodes (LEDs) 242A-F that are aligned with the light ring and that display different colors to indicate that the battery is charging. The LED 242F is hidden in FIG. 7 but is shown schematically in FIG. 17. For example, in the illustrated embodiment, each LED is a two-color LED that emits a red color when a voltage is applied to an R input terminal (see FIG. 17) and emits a green color when a voltage is applied to a G input terminal (see FIG. 17).

Figure 2:
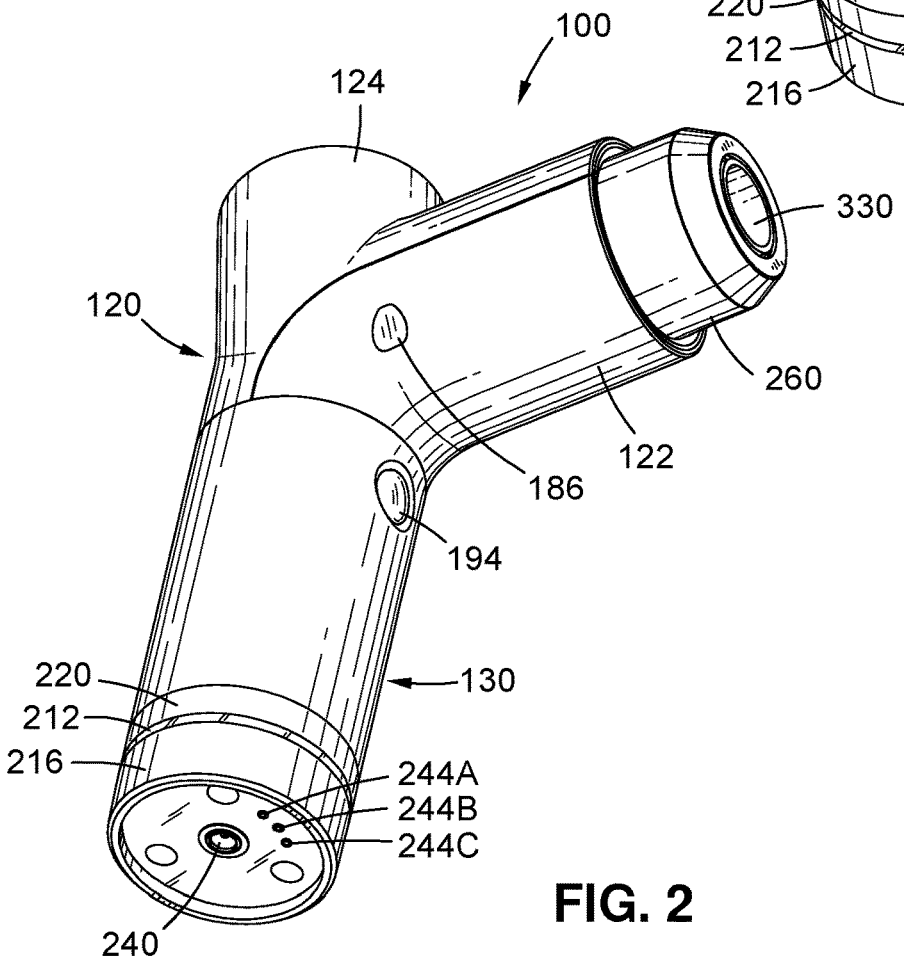
FIG. 2 illustrates a distal, bottom perspective view of the portable electromechanical percussive massage applicator of FIG. 1.
Figure 3:
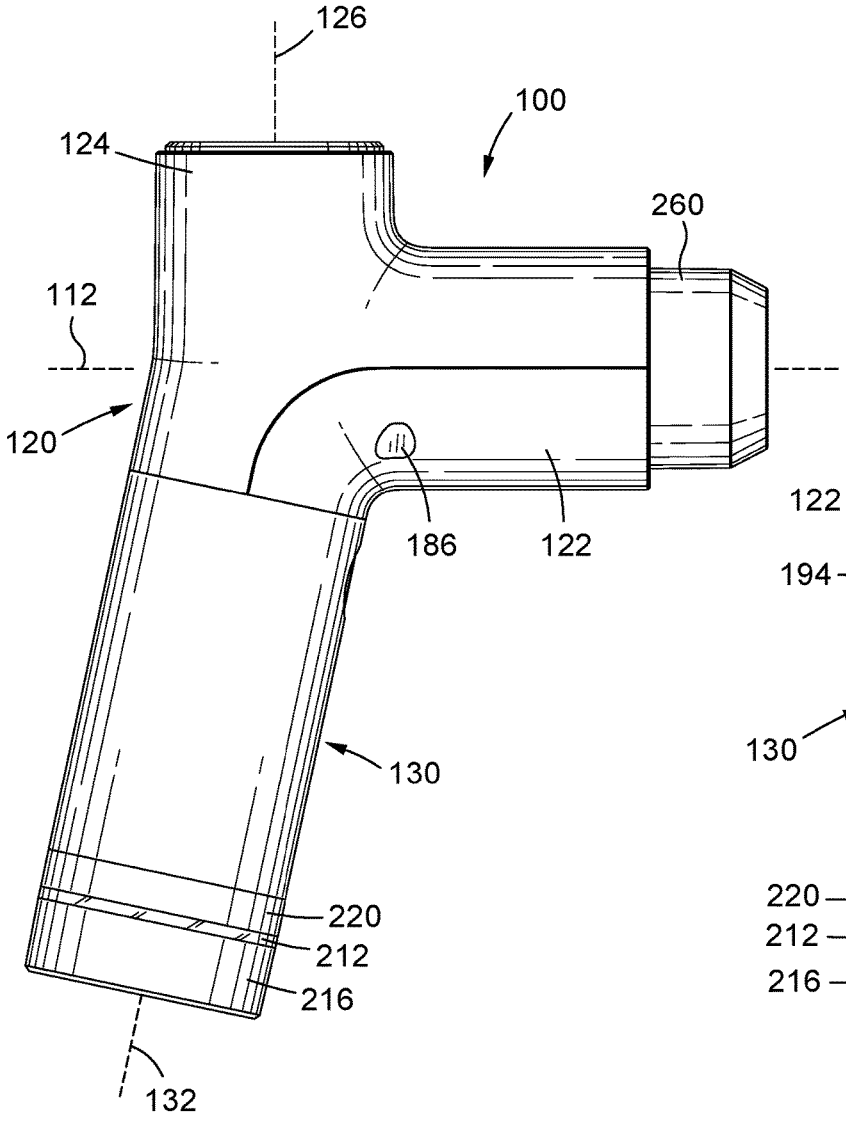
FIG. 3 illustrates an elevational view of the right side of the portable electromechanical percussive massage applicator of FIG. 1.
Figure 4:
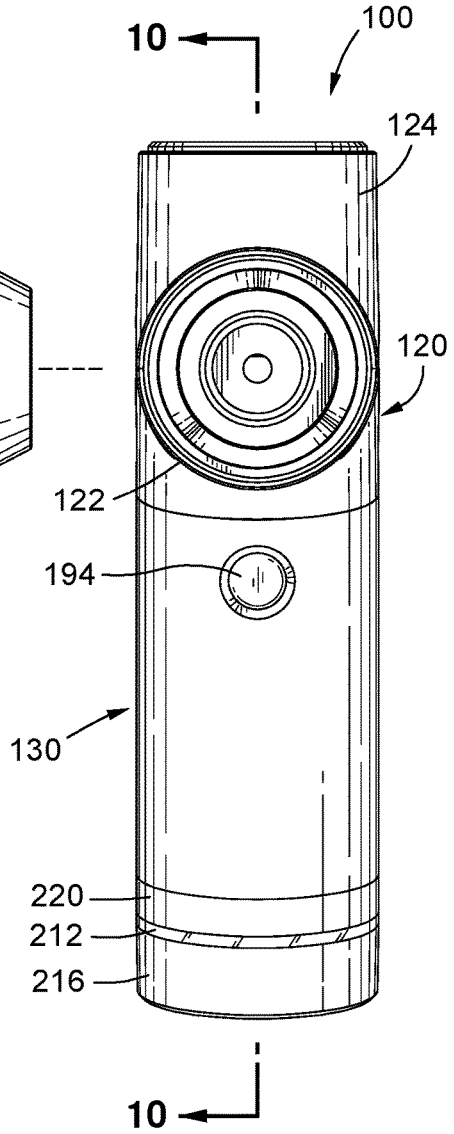
FIG. 4 illustrates an elevational view of the distal end of the portable electromechanical percussive massage applicator of FIG. 1.

As shown in FIGS. 2 and 7, the end cap 216 further includes three speed indicators (e.g., LEDs) 244A-C that are electrically connected to the PCB 214. The three speed indicators are illuminated to indicate a selected reciprocation rate for the percussive massage applicator 100. The PCB supports and interconnects motor controller circuitry, described below, that receives power from the battery 190 and selectively provides power to an electric motor (described below) to drive the electric motor at a selected rotational speed. The electronic circuitry is responsive to activation of the switch 192 to turn the percussive massage device on and off and to cycle the percussive massage device through at least three reciprocation rates (e.g., approximately 2,200 strokes per minute, approximately 2,750 strokes per minute and approximately 3,200 strokes per minute). The electronic circuitry may be constructed by combining the battery controller and the motor controller described in U.S. Pat. No. 10,314,762, which is incorporated herein by reference.

As shown in FIG. 10, a space between the distal upper semicylindrical portion 150 and the distal lower semicylindrical portion 160 of the main enclosure 120 defines a cavity 250 having a distal (or front) opening 252. An outer sleeve 260 is coupled to and extends from the distal opening.

Figure 8:
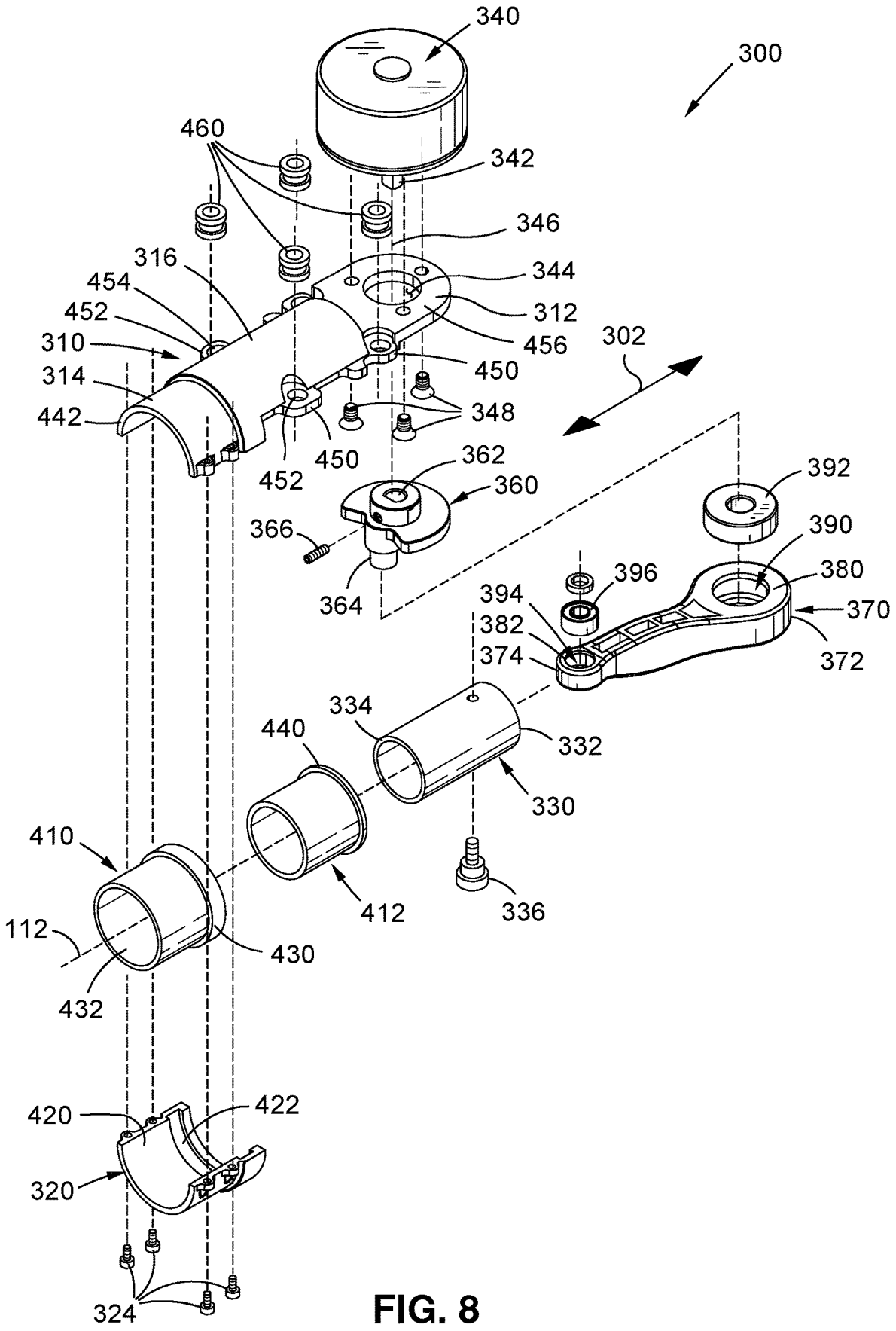
FIG. 8 illustrates an exploded distal, top perspective view of the reciprocation mechanism of FIG. 5.
Figure 9:
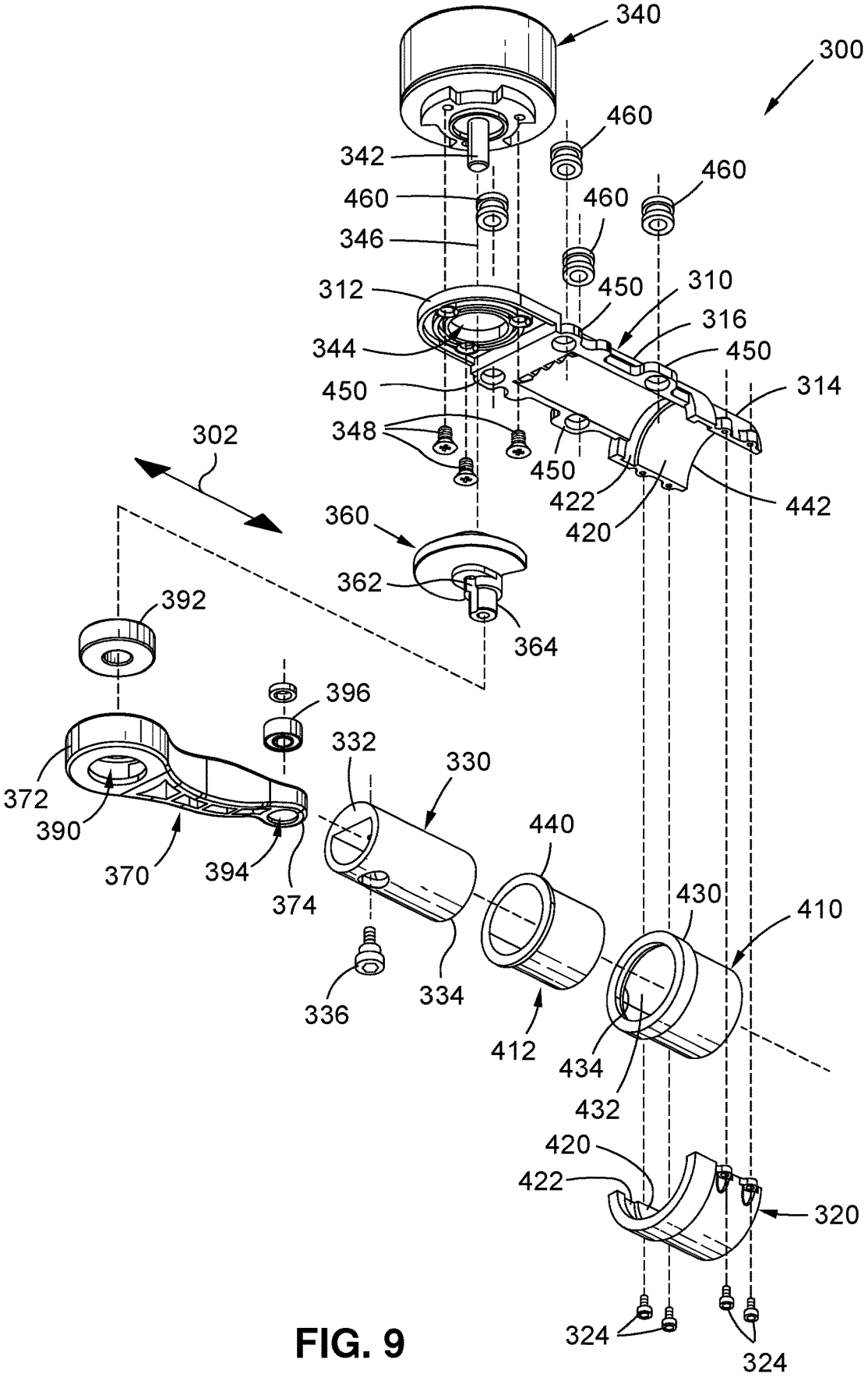
FIG. 9 illustrates an exploded proximal, bottom perspective view of the reciprocation mechanism of FIG. 5.

The percussive massage applicator 100 may further include a reciprocation mechanism 300 positionable within the main enclosure 120 (e.g., within the cavity 250) of the percussive massage applicator. The reciprocation mechanism is coupleable to one of the first enclosure portion 140 or the second enclosure portion 142, however, as illustrated, the reciprocation mechanism is coupled to the second enclosure portion. The reciprocation mechanism may also be referred to herein as a self-contained reciprocation unit or a reciprocation unit. FIGS. 5-7 illustrate perspective views of the reciprocation mechanism as assembled in combination with the percussive massage applicator. FIGS. 8 and 9 illustrate exploded views of the reciprocation mechanism.

Figure 11:
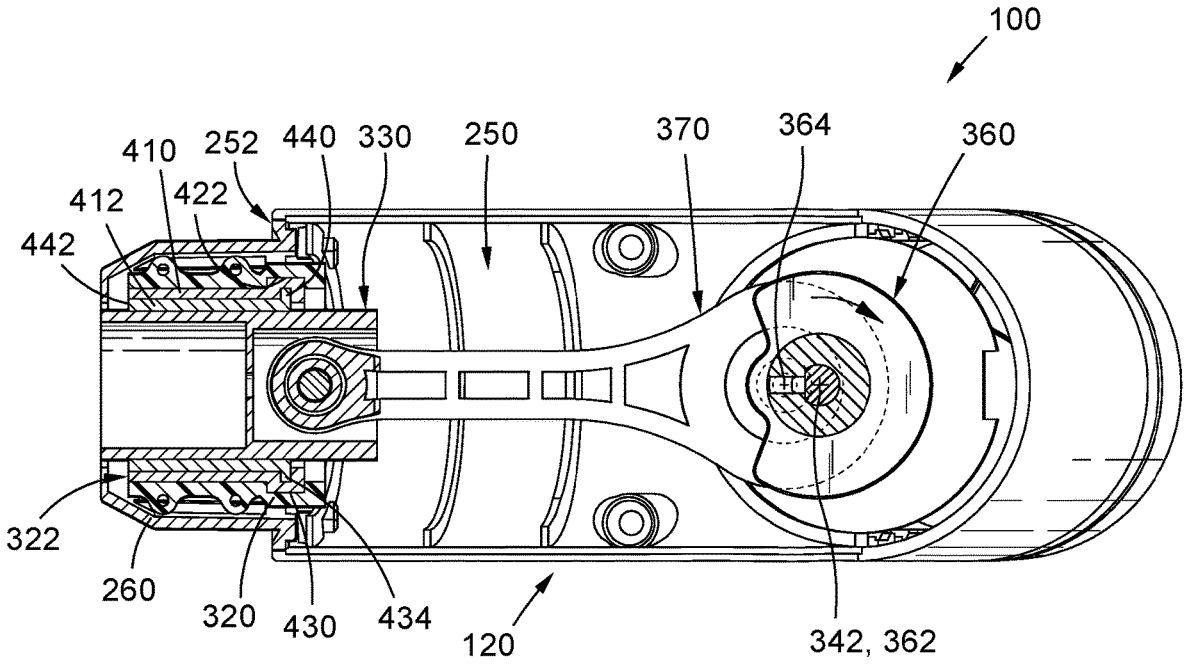
FIG. 11 illustrates a cross-sectional top plan view of the portable electromechanical percussive massage applicator taken along the line 11-11 in FIG. 10 showing the piston in a fully extended (most distal) position.
Figure 12:
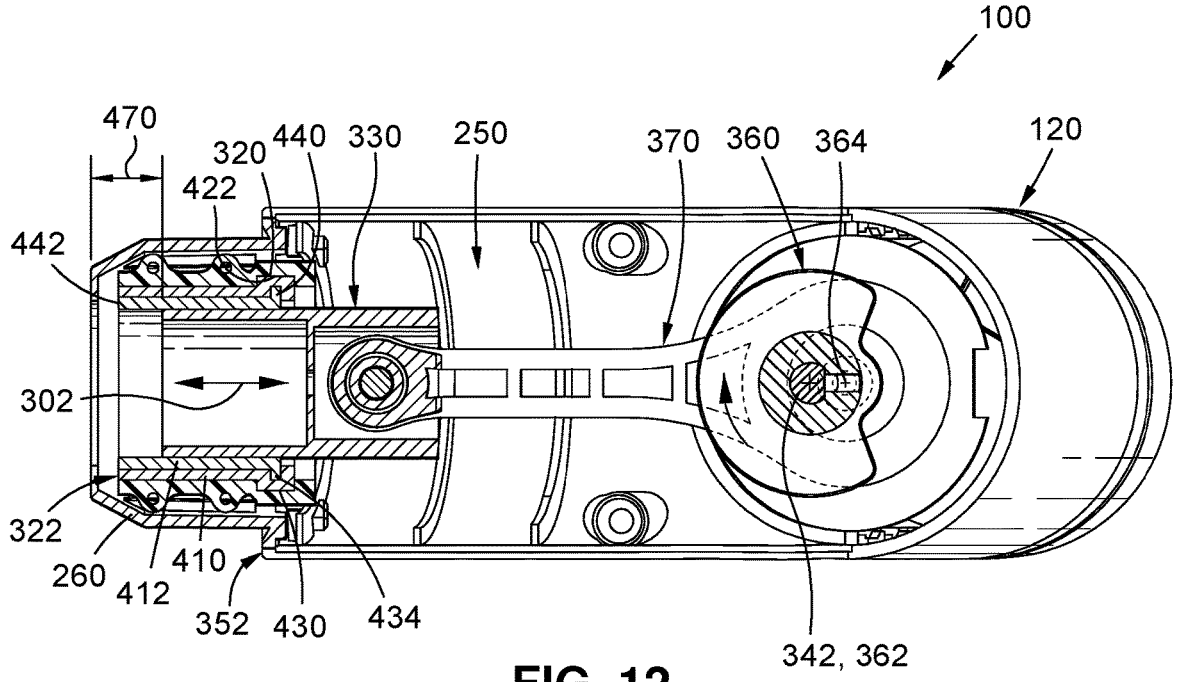
FIG. 12 illustrates the cross-sectional top plan view of FIG. 11 showing the piston in a fully retracted (most proximal) position.

FIGS. 10-12 illustrate cross-sectional views of the percussive massage applicator in combination with the reciprocation mechanism.

As shown in FIGS. 8 and 9, the reciprocation mechanism 300 includes a spatial positioning bracket 310. The spatial positioning bracket is configured to receive various interconnected components of the reciprocation mechanism and assure that those components are properly positioned to provide consistent operating characteristics. The spatial positioning bracket includes a motor mounting portion 312 formed as a flat plate, a downwardly facing open semi-cylindrical end portion 314, and a downwardly facing open partially cylindrical middle portion 316 positioned between the motor mounting portion and the semi-cylindrical end portion. The semi-cylindrical end portion and the partially cylindrical middle portion are configured to extend along a longitudinal direction 302 which may be parallel to the reciprocation axis 112 when the reciprocation mechanism is installed within the main enclosure 120 of the percussive massage applicator 100. Each of the motor mounting portion, the downwardly open semi-cylindrical end portion, and the downwardly open partially cylindrical middle portion may be integrally formed as a single unit. In other embodiments, the downwardly open partially cylindrical middle portion may be shaped differently and thus may also be referred to herein as a middle portion.

The reciprocation mechanism 300 further includes an upwardly facing semi-cylindrical bracket 320 coupleable to the downwardly facing semi-cylindrical end portion 314 of the spatial positioning bracket 310. When combined, the semi-cylindrical bracket in combination with the semi-cylindrical end portion define a cylindrical passageway 322 (shown in FIG. 10) along the longitudinal direction 302. The semi-cylindrical bracket is secured to the semi-cylindrical end portion of the spatial positioning bracket via a plurality of bracket mounting screws 324.

The reciprocation mechanism 300 further includes a piston 330 configured to be slidably positioned within the cylindrical passageway 322. The piston is constrained to move (or reciprocate) along the longitudinal direction 302 (corresponding to the reciprocation axis 112) when the reciprocation mechanism is installed within the main enclosure 120 of the percussive massage applicator 100. The piston includes a first piston end 332, a second piston end 334 and a piston pin 336. The second piston end is configured to removably receive the second applicator end 116 of the applicator head 110.

The reciprocation mechanism 300 further includes an electric motor 340 coupled to the motor mounting portion 312 of the spatial positioning bracket 310. The electric motor includes a rotatable shaft 342 extending through a central hole 344 defined in the motor mounting portion of the spatial positioning bracket such that the rotatable shaft extends below the motor mounting portion. The rotatable shaft defines a central axis 346 perpendicular to the longitudinal direction 302. The central axis may be the same as the motor axis 126 when the reciprocation mechanism is installed within the main enclosure 120 of the percussive massage applicator 100.

In the illustrated embodiment, the electric motor 340 is a DC motor such as a JRB-4520-045018-P5 12-volt DC brushless direct current motor commercially available from Guangdong Kingly Gear Co., Ltd., of Guangdong, China. The electric motor may be a commercially available motor. The diameter and height of the motor enclosure portion 124 of the main enclosure 120 is configured to receive the electric motor within the motor enclosure portion when the reciprocation mechanism 300 is installed within the main enclosure of the percussive massage applicator 100. The electric motor is secured to the motor mounting portion 312 of the spatial positioning bracket 310 via a plurality of motor mounting screws 348.

The reciprocation mechanism 300 further includes a crank 360 (or "eccentric crank") including a central crank bore 362 configured to receive the rotatable shaft 342 of the electric motor 340 such that the crank is positioned below the motor mounting portion 312 of the spatial positioning bracket 310. The crank further includes a downwardly extending post 364 offset from the central crank bore by a selected distance (e.g., 2.8 millimeters in the illustrated embodiment). The post may also be referred to herein as a pivot. The post extends away from the rotatable shaft of the electric motor when coupled to the central crank bore. The rotatable shaft of the electric motor is fixedly coupleable within the central crank bore using a screw 366 (shown in FIG. 10).

The reciprocation mechanism 300 further includes a reciprocation linkage 370 having a first linkage end 372 and a second linkage end 374. The first linkage end 372 is coupled to the post 364 of the crank 360. The second linkage end 374 is received by and coupled to the first piston end 332 of the piston 330. The reciprocation linkage has a fixed length. The reciprocating linkage is configured to convert rotational movement of the post about the central crank bore 362 caused by the electric motor 340 at the first linkage end to reciprocal movement of the piston 330 along the longitudinal direction 302 at the second linkage end.

The first linkage end 372 of the reciprocation linkage 370 includes a first linkage end upper surface 380. The second linkage end 374 includes a second linkage end upper surface 382 positioned parallel to both the first linkage end upper surface and the longitudinal direction 302. The second linkage end upper surface is offset above the first linkage end upper surface. When the reciprocation linkage is positioned below the spatial positioning bracket 310 as shown in FIG. 10, the position of the second linkage end upper surface with respect to the spatial positioning bracket is closer than the position of the first linkage end supper surface with respect to the spatial positioning bracket.

The first linkage end 372 includes a first linkage end receptacle 390 open to the first linkage end upper surface 380 and configured to receive a first linkage end ball bearing coupler 392. The first linkage end ball bearing coupler is configured to receive the post 364 of the crank 360. The first linkage end ball bearing coupler is configured to enable a rotatable coupling between the first linkage end and the post of the crank. The first linkage end ball bearing coupler substantially reduces the frictional resistance that would otherwise be present as the first linkage end rotates about the rotatable shaft while the post while the second linkage end remains aligned with the longitudinal direction 302.

The second linkage end 374 includes a second linkage end receptacle 394 open to the second linkage end upper surface 382 and configured to receive a second linkage end ball bearing coupler 396. The piston pin 336 is configured to extend through the second linkage end ball bearing coupler. The piston pin may be, for example, a screw or bolt. In the illustrated embodiment, the piston pin includes a smooth portion configured to be snugly received by the second linkage end ball bearing coupler. The second linkage end ball bearing coupler allows pivotal movement of the second linkage end while the linkage in combination with the electric motor 340 and the crank 360 moves the piston along the longitudinal direction 302 within the cylindrical passageway 322.

The reciprocation mechanism 300 includes a cylindrical sleeve 410 positioned within the cylindrical passageway 322. The reciprocation mechanism further includes a cylindrical body 412 positioned within the cylindrical sleeve. The cylindrical body is configured to slidably receive the piston 330 therethrough such that the piston reciprocates along the longitudinal direction 302. The cylindrical sleeve serves as a vibration damper to reduce vibrations propagating from the cylindrical body to the main enclosure 120 of the percussive massage applicator 100.

An inner surface 420 of the cylindrical passageway 322 (FIG. 10), defined by each of the semi-cylindrical end portion 314 of the spatial positioning bracket 310 and the semi-cylindrical bracket 320 being mated together, includes a circumferential (or circular) passageway channel 422 defined therein. Each of the inner surface and the circumferential passageway channel is labeled separately on the semi-cylindrical end portion of the spatial positioning bracket and the semi-cylindrical bracket in FIGS. 8 and 9 since these elements are most clearly visible in these illustrations.

The cylindrical sleeve 410 includes a radially extending sleeve rim 430 configured to be received by the circumferential passageway channel 422. The interlocking engagement between the radially extending sleeve rim and the circumferential passageway channel prevents movement of the cylindrical sleeve along the longitudinal direction 302.

An inner surface 432 of the cylindrical sleeve 410 includes a circumferential (or circular) sleeve channel 434 aligned with the radially extending sleeve rim 430. The cylindrical body 412 includes a radially extending body rim 440 configured to be received by the circumferential sleeve channel. The interlocking engagement between the circumferential sleeve channel and the radially extending body rim, in combination with the interlocking engagement between the radially extending sleeve rim and the circumferential passageway channel 422, prevents movement of the cylindrical body along the longitudinal direction 302.

The circumferential passageway channel 422 of the cylindrical passageway 322 is positioned nearer to the partially cylindrical middle portion 316 of the spatial positioning bracket 310 than to a free (or distal) end 442 of the semi-cylindrical end portion 314 of the spatial positioning bracket. The free end of the spatial positioning bracket is positioned distal to the motor mounting portion 312 of the spatial positioning bracket. Furthermore, ends of each of the cylindrical sleeve 410 and the cylindrical body 412 are positioned distal to their respective radially extending rims and are aligned with the free end of the semi-cylindrical end portion (shown in FIG. 10).

The spatial positioning bracket 310 further includes a plurality of mounting tabs 450. Each tab includes an upper mounting tab surface 452 and a central mounting tab bore 454. The motor mounting portion 312 of the spatial positioning bracket includes an upper motor mounting surface 456 parallel with the longitudinal direction 302. The upper mounting tab surface of each of the plurality of mounting tabs is coplanar with the upper motor mounting surface.

Each of the plurality of mounting tabs 450 is integrally formed as part of one or more of the motor mounting portion 312 or the partially cylindrical middle portion 316 of the spatial positioning bracket 310. As illustrated, the partially cylindrical middle portion includes two mounting tabs extending from opposite sides thereof and the partially cylindrical middle portion includes two mounting tabs extending from opposite sides.

The reciprocation mechanism 300 further includes a plurality of rubber grommets 460, each positioned through and surrounding the central mounting tab bore 454 of a respective one of the plurality of mounting tabs 450. The plurality of rubber grommets are configured to dampen vibrations from the electric motor 340 to the main enclosure 120 of the percussive massager applicator 100 when the reciprocation mechanism is coupled to the main enclosure and the electric motor is operational.

As shown in FIGS. 5 and 6, the reciprocation mechanism is coupleable to the main enclosure using a plurality of mounting screws 462, each extending through the central mounting tab bore 454 of one of the plurality of mounting tabs 450 and its associated rubber grommet 460. The plurality of mounting screws are illustrated as coupling the reciprocation mechanism to the second enclosure portion 142, however, it is contemplated that the plurality of mounting screws could couple the reciprocation mechanism to the first enclosure portion 140.

The operation of the percussive massage applicator 100 is illustrated in FIGS. 11 and 12, which are views looking down at the reciprocation mechanism 300 in the second enclosure portion 142 of the main enclosure 120 with the first enclosure portion 140 removed. In FIG. 11, the crank 360 attached to the rotatable shaft 342 of the electric motor 340 is shown at an extended reference position. In this extended reference position, the post 364 of the eccentric crank is at a distal location nearest the free end 442 (FIGS. 8 and 9) of the semi-cylindrical end portion 314 of the spatial positioning bracket 310. The post is positioned closer to the free end of the semi-cylindrical end portion than the central crank bore 362. In this extended reference position, the piston 330 and the reciprocation linkage 370 are both aligned with the longitudinal direction 302.

As shown in FIG. 12, the rotatable shaft 342 of the electric motor 340 has rotated the crank 360 clockwise 180-degrees to a position designated as the retracted reference position. The post 364 of the eccentric crank generally moves in a clockwise direction about central crank bore 362. In this retracted reference position, the post of the eccentric crank is at a proximal location furthest from the free end 442 of the semi-cylindrical end portion 314 of the spatial positioning bracket 310. The post is positioned further from the free end of the semi-cylindrical end portion than the central crank bore. In this retracted reference position, the piston 330 and the reciprocation linkage 370 are both aligned with the longitudinal direction 302.

The positional difference of the piston between the extended reference position and the retracted reference position defines a stroke length 470 (shown in FIG. 12). The stroke distance may, for example, be 10 millimeters.

The reciprocation mechanism 300 eliminates issues which may be confounded by mounting the electric motor 340 to the main enclosure 120 separate from the cylindrical sleeve 410 and cylindrical body 412. The spatial positioning bracket 310 ensures that the various elements of the reciprocation mechanism are positioned relative to each other with close tolerances to assure that the interconnected components are properly positioned to provide consistent operating characteristics.

As shown in FIGS. 10-12, at least a portion of the reciprocation mechanism 300 is configured to extend beyond the distal opening 252 of the cavity 250. As illustrated, a portion of the semi-cylindrical end portion 314 of the spatial positioning bracket 310 extends beyond the distal opening. The outer sleeve 260 is coupled to the distal opening of the cavity and is configured to cover and/or protect the portion of the reciprocation mechanism extending beyond the distal opening. As shown in FIG. 10, the second piston end 334 may align with an end of the outer sleeve when the piston is in the extended reference position.

While certain elements of the reciprocation mechanism 300 are oriented using directional language such as upper, lower, above, below, or the like, this language is not meant to be limited. A person of ordinary skill should understand that the invention could be oriented upside down relative to its orientation as illustrated and not depart from the intended scope of this disclosure.

As shown in FIG. 10, the percussive massage applicator 100 may further be provided with a wire management bracket 480 extending from the second enclosure portion 142 near the battery 190 and positioned between the reciprocation mechanism 300 and the first enclosure portion 140 of the main enclosure 120. The wire management bracket defines a wire channel 482 between the wire management bracket and the first enclosure portion. The wire management bracket is configured to route a five-wire cable 484 that extends from the PCB 214 to the electric motor 340. The wire management bracket protects the five-wire cable from the various moving components of the reciprocation mechanism.

Figure 13:
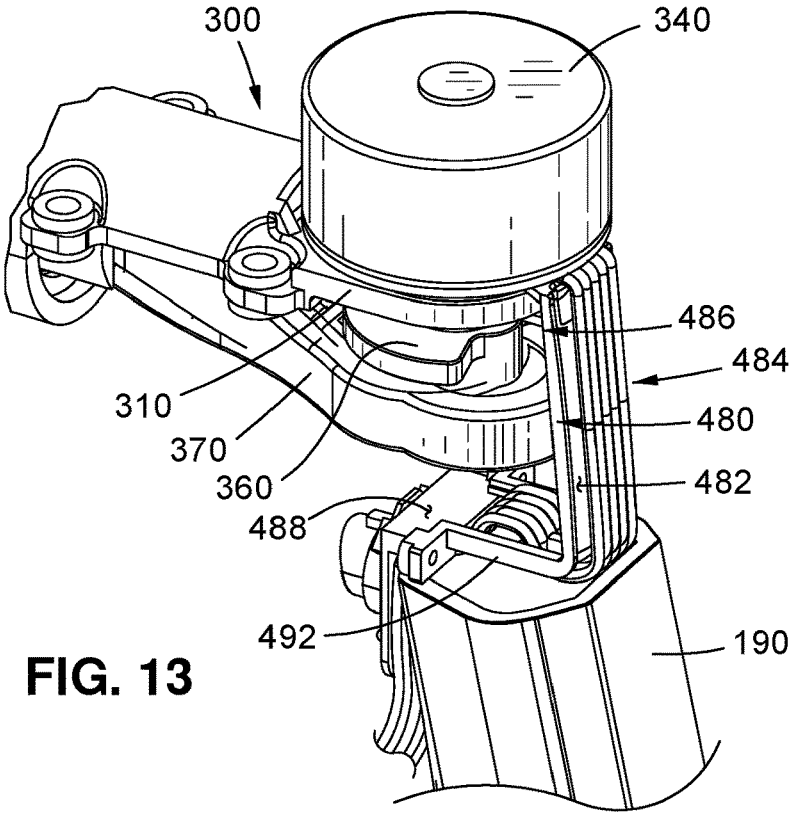
FIG. 13 illustrates an enlarged proximal perspective view of the portable electromechanical percussive massage applicator, the battery, and the wire management bracket of FIG. 10.
Figure 14:
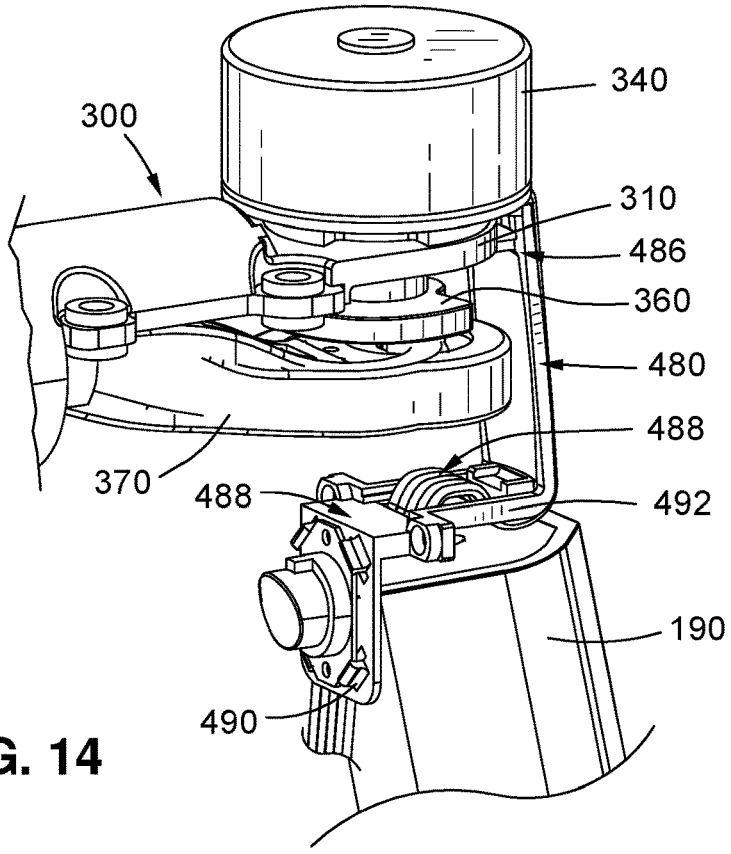
FIG. 14 illustrates an enlarged distal perspective view of the portable electromechanical percussive massage applicator, the battery, and the wire management bracket of FIG. 13.
Figure 15:
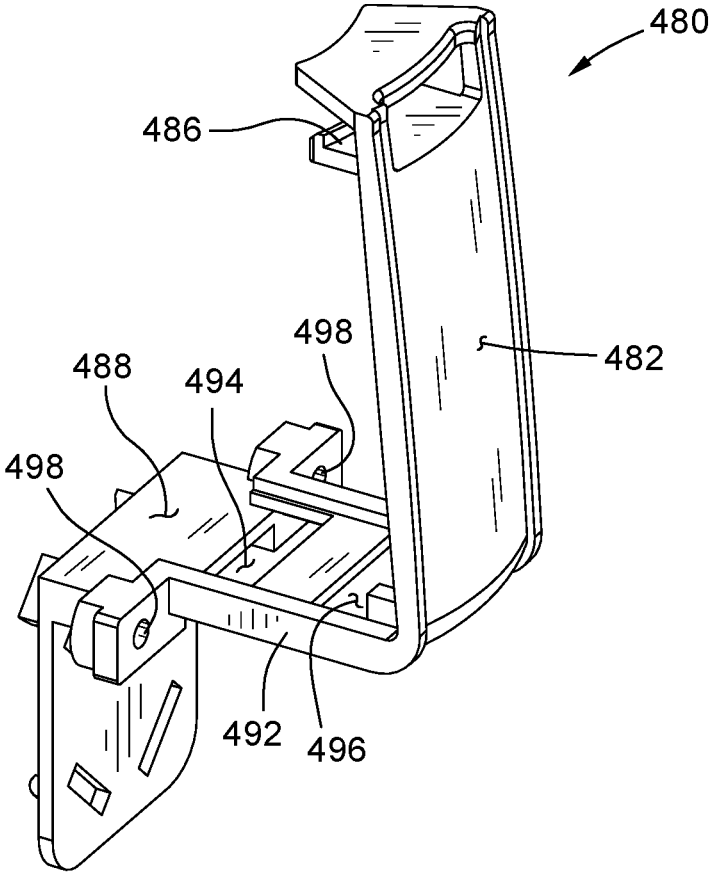
FIG. 15 illustrates a proximal perspective view of the wire management bracket of FIG. 10.
Figure 16:
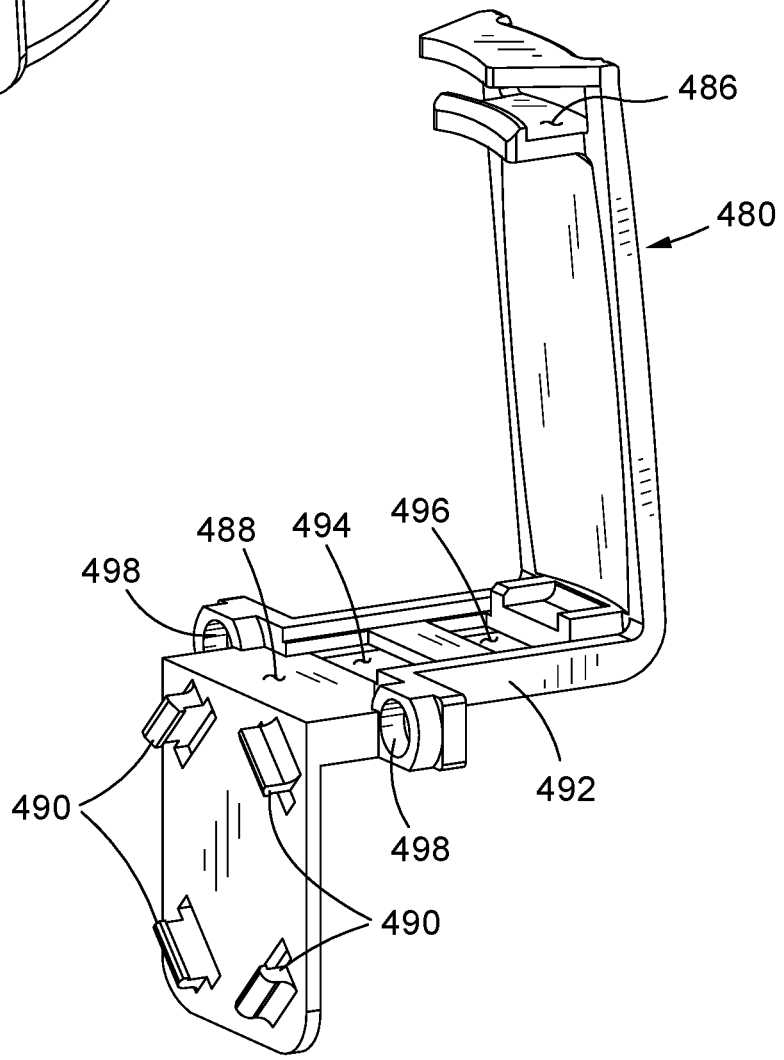
FIG. 16 illustrates a distal perspective view of the wire management bracket of FIG. 15.

As shown in FIGS. 10 and 13-16, the wire management bracket 480 includes an upper clamping portion 486 configured to engage the proximal end of the spatial mounting bracket 310 of the reciprocation mechanism 300. The wire management bracket 480 further includes lower portion 488, which is secured to the inside of the second enclosure portion 142. The lower portion 488 further includes a lower clamping portion 490 configured to engage a bracket of the switch 192. A horizontal portion 492 of the wire management bracket includes a first rectangular opening 494 and a second rectangular opening 496 (FIGS. 15 and 16). The wire management bracket is secured to the second enclosure portion via a pair of screws (not shown) inserted through a pair of through bores 498. The five-wire cable is routed through the two rectangular openings as shown in FIGS. 10, 13 and 14 to hold the five-wire cable 484 in position against the wire channel 482. A lower end (not shown) of the five-wire cable 484 includes a connector (not shown) that engages a motor connector 502 (FIG. 5).

Figure 17:
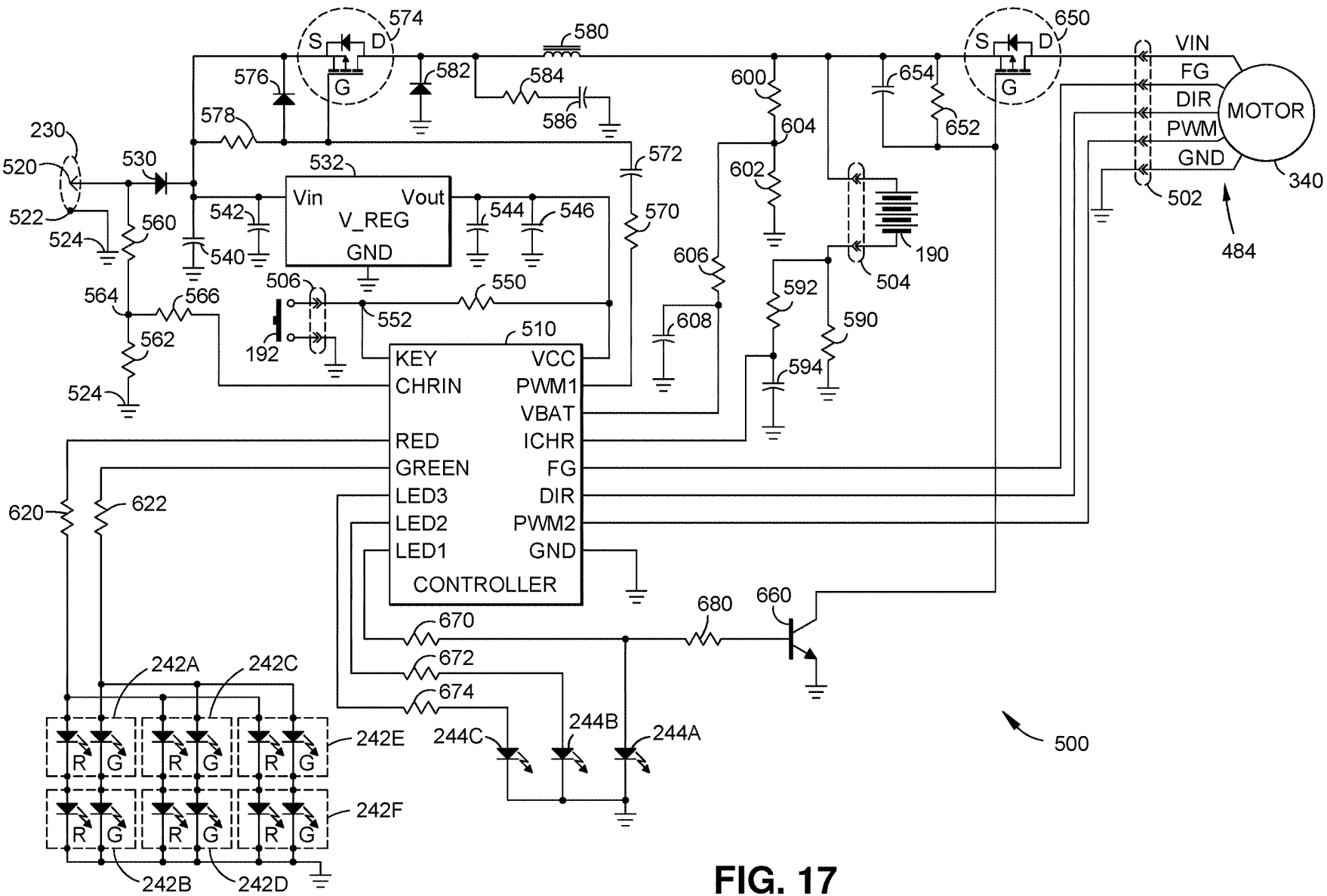
FIG. 17 illustrates a block diagram of battery controller and motor controller circuits the portable electromechanical percussive massage applicator of FIG. 1.

The portable electromechanical percussive massage applicator 100 may be provided with power and controlled in a variety of manners. An exemplary battery control circuit is described, for example, with respect to FIG. 23 of the above-identified U.S. Pat. No. 10,314,762. Exemplary motor control circuits are described, for example, with respect to FIG. 24 and FIG. 27 of the same patent. FIG. 17 illustrates a block diagram of a combined battery controller and motor controller 500 that is mounted on the PCB 214. The combined battery and motor controller is electrically connected to the power adapter connector 240. The combined battery and motor controller is connected to the motor 340 via the motor connector 502, is connected to the battery via a battery connector 504 and is connected to the switch 192 via a switch connector 506, which are shown in FIG. 5.

The combined battery controller and motor controller 500 is controlled by a processor 510, which may be a microcontroller unit (MCU) or other digital processor having analog inputs and outputs. As described below, the processor monitors the battery 190 and the motor 340 and generates signals to control the charging of the battery and to control the speed of the motor. The processor is responsive to activation of the switch 192 to selectively turn the motor on and to select one of three rotational speeds for the motor. The processor further selectively activates the three LEDs 244A-C to indicate the speed of the motor. As described below, the processor further selectively activates the LEDs 242A-F to indicate when the battery is being charged when connected to an external DC power source (not shown) such as a conventional 18-volt power adapter.

The combined battery controller and motor controller 500 receives DC power from the external power source (not shown) via the power adaptor connector 240. A center terminal 520 of the power adapter connector receives a positive DC voltage. An outer terminal 522 of the power adapter connector is coupled to a ground reference 524 of the combined battery controller and motor controller.

The positive DC voltage from the center terminal 520 of the power adapter connector 240 is coupled to the anode of an input diode 530. The cathode of the input diode is connected to the input terminal (Vin) of a conventional 5-volt voltage regulator 532, which has an output terminal (Vout). A first regulator input filter capacitor 540 and a second regulator input filter capacitor 542 are connected to the input terminal of the voltage regulator. A first regulator filter capacitor 544 and a second regulator output filter capacitor 546 are connected to the output terminal of the voltage regulator. The voltage regulator is responsive to the voltage on the input terminal to provide a regulated DC voltage (e.g., 5 volts) on the output terminal.

The regulated DC voltage from the voltage regulator 532 is connected to the voltage input (VCC) of the processor 510. The regulated DC voltage from the voltage regulator is also connected to a first terminal of a pullup resistor 550. A second terminal of the pullup resistor is connected to a first terminal of the switch 192 via the switch connector 506 at a switch node 552. A second terminal of the switch is connected to the common ground reference via the switch connector. The switch node is connected to a KEY input of the processor 510. The switch may be hardwired to the PCB 214 or may be connected via a connector (not shown). When the switch is open, the KEY input is pulled up to the magnitude of the regulated DC voltage (e.g., 5 volts). When the switch is closed, the KEY input is pulled down to the ground reference (e.g., 0 volts). The processor is responsive to changes in the voltage on the KEY input to sense activation of the switch by a user and to control the operation of the motor 340 as described below.

The positive DC voltage from the center terminal 520 of the power adapter connector 240 is also coupled to a voltage divider circuit comprising a first divider resistor 560 and a second divider resistor 562 connected in series between the center terminal and the ground reference 524. The resistances of the two resistors are selected to provide a voltage of approximately 1.6 volts at a common node 564 between the two resistors when the positive DC voltage is approximately 18 volts. The common node is coupled to a CHRIN input terminal of the processor 510 via a coupling resistor 566. The processor is responsive to the presence of the voltage on the CHRIN input terminal to operate the battery charging circuitry described below.

The processor 510 has a first pulse width modulation output terminal PWM1, which is connected to a first terminal of pulse coupling resistor 570. A second terminal of the pulse coupling resistor is connected to first terminal of a pulse coupling capacitor 572. A second terminal of the pulse coupling capacitor is connected to the gate terminal (G) of a first power MOSFET (metal oxide semiconductor field effect transistor) 574. The source terminal (S) of the first power MOSFET is connected to the cathode of the input diode 530. A gate voltage limiting diode 576 has an anode connected to the gate terminal of the first power MOSFET and has a cathode connected to the source terminal of the first power MOSFET. A gate pullup resistor 578 is connected across the gate voltage limiting diode.

The drain terminal (D) of the first power MOSFET 574 is connected to a first terminal of an inductor 580 and to the cathode of a free-wheeling (or flyback) diode 582. The anode of the free-wheeling diode is connected to the ground reference 524. An inductor input circuit resistor 584 and an inductor input circuit capacitor 586 are connected in series between the first terminal of the inductor and the ground reference.

A second terminal of the inductor 580 is connected to the positive terminal of the battery 190 via the battery connector 504. The negative terminal of the battery is connected to a first terminal of a current sensing resistor 590 via the battery connector. The two terminals of the battery may be hard-wired to the PCB 214 or may be connected via a connector (not shown). A second terminal of the current sensing resistor is connected to the ground reference 524. In the illustrated embodiment, the current sensing resistor has a resistance of approximately 0.05 ohm (0.05Ω). When current flows through the battery, a voltage develops across the current sensing resistor proportional to the magnitude of the current. The developed voltage is fed back to an ICHR input of the processor 510 via a current sense feedback resistor 592. A current sense filter capacitor 594 is connected between the ICHR input of the processor and the ground reference.

A battery voltage sensing circuit comprises a first battery voltage divider resistor 600 and a second voltage divider resistor 602 connected in series between the positive terminal of the battery 190 and the ground reference 524. The two resistors are connected at a battery voltage sensing node 604. The voltage at the battery voltage sensing node is fed back to a VBAT input terminal of the processor 510 via a battery voltage sensing feedback resistor 606. A voltage sensing circuit filter capacitor 608 is connected between the VBAT input terminal and the ground reference.

When a power adapter (not shown) is connected to the power adapter connector 240, the processor 510 senses the active voltage at the CHRIN input terminal and selectively generates pulses on the PWM1 output terminal. The pulses are coupled to the gate terminal (G) of the first power MOSFET 574 via the pulse coupling resistor 570 and the pulse coupling capacitor 572. The first power MOSFET turns on in response to each pulse and provides current to the inductor 580. The current through the inductor is provided as a charge current to the battery 190. When the first power MOSFET turns off, the free-wheeling diode 582 allows the current within the inductor to discharge through the battery to continue to charge the battery. The processor monitors the battery voltage and the battery current via the VBAT input terminal and the ICHR input terminal, respectively, and controls the pulses on the PWM1 output terminal to charge the battery to a selected voltage level (e.g., 12 volts) without overcharging the battery and without allowing the charging current to exceed a selected maximum charging current.

When the processor 510 is charging the battery, the processor selectively outputs a first signal on a RED output terminal and a second signal on a GREEN output terminal. The RED output terminal is connected via a first LED current limiting resistor 620 to the red (R) input terminals of the two-color LEDs 242A-F. The GREEN output terminal is connected via a second LED current limiting resistor 622 to the green (G) input terminals of the two-color LEDs. The signals applied to the red and green input terminals of the two-color LEDs may be varied by controlling the duty cycles of the signals to cause the effective colors generated by the LEDs to vary. For example, only the red signal may be activated to generate red light to indicate that the battery is fully discharged and is being charged. Only the green signal may be activated to indicate that the battery is fully charged. The two signals may be activated with varying duty cycles to indicate different levels of charge between fully discharged and fully charged.

As illustrated in FIG. 17, the motor 340 has five terminals connected to the five-wire cable 484. The five-wire cable may be hardwired to the PCB 214 or may be connected via the motor connector 502 as shown in FIG. 17. The motor receives power on a voltage input terminal (VIN). The power is received with respect to the ground reference 524 a ground terminal (GND). The direction of rotation of the motor is controlled by a direction signal on a direction input terminal (DIR). The direction input terminal of the motor is connected to a DIR output terminal of the processor 510. The motor speed is controlled by a pulse width modulation signal on a pulse width modulation input terminal (PWM). The pulse width modulation input terminal of the motor is connected to a PWM2 output terminal of the processor. The motor provides feedback to the processor via a frequency generation signal on a frequency generator output terminal (FG). The frequency generator output terminal of the motor is connected to an FG input terminal of the processor. The frequency of the frequency generation signal is directly proportional to the rotation rate of the motor.

The voltage applied to the voltage input terminal of the motor 340 is provided from the drain terminal (D) of a second power MOSFET 650, which has a source terminal (S) connected to the positive terminal of the battery 190. The second power MOSFET is controlled by a signal on a gate terminal (G). When the voltage on the gate terminal is low, the second power MOSFET conducts and provides the battery voltage to the motor. When the gate terminal is high, the second power MOSFET does not conduct and no voltage is provided to the motor. The gate of the second power MOSFET is pulled up to the battery voltage by a second power MOSFET pullup resistor 652. A filter capacitor 654 is connected across the second power MOSFET pullup resistor.

The gate terminal of the second power MOSFET 650 is controlled by a semiconductor switch 660. In the illustrated embodiment, the semiconductor switch is an NPN transistor having a base, an emitter and a collector. The emitter of the switching transistor is connected to the ground reference 524. The collector of the switching transistor is connected to the gate terminal of the second power MOSFET. The base of the switching transistor is controlled by the processor 510 as described below. When a high voltage is applied to the base of the switching transistor, the switching transistor turns on and causes the collector voltage to be pulled down to a low voltage. The low voltage on the collector of the switching transistor causes the second power MOSFET to conduct and provide the battery voltage to the motor 340.

When the battery voltage is applied to the motor 340, the processor 510 controls the direction of the rotation of the motor by the state of the DIR output signal applied to the direction (DIR) input of the motor. In the illustrated embodiment, the direction is always the same (e.g., clockwise (CW)). The processor controls the rotational speed of the motor by varying the duty cycle of the PWM2 signal applied to the pulse width modulation input terminal (PWM) of the motor. The processor monitors the signal on the FG output terminal of the motor to determine whether the motor is operating at the selected rotational rate. The processor selectively varies the PWM2 signal to maintain the motor at the selected rotational rate. As discussed above, the selected rotational rated is selected by activating the switch 192.

The processor 510 selectively activates the three speed indicator LEDs 244A-C to indicate the selected rotational rate of the motor 340. A first LED output signal is generated on an LED1 output terminal of the processor and is conducted to the anode of the first speed indicator LED 244A via a first speed indicator current limiting resistor 670. A second LED output signal is generated on an LED2 output terminal of the processor and is conducted to the anode of the second speed indicator LED 244B via a second speed indicator current limiting resistor 672. A third LED output signal is generated on an LED3 output terminal of the processor and is conducted to the anode of the third speed indicator LED 244C via a third speed indicator current limiting resistor 674. In the illustrated embodiment, the speed indicator LEDs are activated in a cascade sequence. When the motor is rotating at the first rotational speed, the processor activates only the first speed indicator LED. When the motor is rotating at the second rotational speed, the processor activates the second speed indicator LED along with the first speed indicator LED. When the motor is rotating at the third rotational speed, the processor activates the third speed indicator LED along with the first and second speed indicator LEDs. Accordingly, the user can determine which rotational speed is selected by the number of speed indicator LEDs that are illuminated.

Since the first LED output signal on the LED1 output terminal is active for all three rotational speeds, the first LED output signal is also used to control the semiconductor switch 660. A base resistor 680 connects the anode of the first speed indicator LED 244A to the base of the semiconductor switch. Accordingly, the base of the semiconductor switch is driven whenever, the first speed indicator LED is illuminated such that battery power is applied to the motor 340 via the second power MOSFET 650. In alternative embodiments, the semiconductor switch can be driven by a separate signal generated by the processor 510.

As various changes could be made in the above constructions without departing from the scope of the invention, it is intended that all the matter contained in the above description or shown in the accompanying drawings shall be interpreted as illustrative and not in a limiting sense.

What is claimed is:

1. A self-contained reciprocation mechanism coupleable within an enclosure of a percussive massage device and configured to receive an applicator head, the self-contained reciprocation mechanism comprising:

a spatial positioning bracket including a motor mounting portion formed as a flat plate, a semi-cylindrical end portion, and a middle portion positioned between the motor mounting portion and the semi-cylindrical end portion, the semi-cylindrical end portion and the middle portion are each formed as a partial cylinder extending away from the motor mounting portion along a longitudinal direction, and the motor mounting portion, the middle portion, and the semi-cylindrical end portion form an integral unit;

a semi-cylindrical bracket coupleable to the semi-cylindrical end portion of the spatial positioning bracket to define a cylindrical passageway along the longitudinal direction;

a piston slidably positioned within the cylindrical passageway, the piston having a first piston end and a second piston end, the piston constrained to move only along the longitudinal direction through the cylindrical passageway, the second piston end configured to receive the applicator head;

a motor coupled to the motor mounting portion of the spatial positioning bracket, the motor including a rotatable shaft extending below the motor mounting portion, the shaft having a central axis oriented perpendicular to the longitudinal direction;

a crank including a central bore configured to receive the shaft of the motor such that the crank is positioned below the motor mounting portion of the spatial positioning bracket, the crank further including a downwardly extending post offset from the central axis of the shaft; and a reciprocation linkage having a first linkage end and a second linkage end, the first linkage end coupled to the post of the crank, the second linkage end coupled to the first piston end.

2. The self-contained reciprocation mechanism as defined in claim 1, wherein:

the first linkage end includes a first linkage end upper surface and the second linkage end includes a second linkage end upper surface positioned parallel to both the first linkage end upper surface and the longitudinal direction; and the second linkage end upper surface is offset above the first linkage end upper surface.

3. The self-contained reciprocation mechanism as defined in claim 1, wherein:

the first linkage end includes a first linkage end receptacle configured to receive a first linkage end ball bearing coupler; and the first linkage end ball bearing coupler is configured to receive the downwardly extending post of the crank.

4. The self-contained reciprocation mechanism as defined in claim 1, wherein:

the second linkage end includes a second linkage end receptacle configured to receive a second linkage end ball bearing coupler; and the first piston end includes a piston pin configured to extend through the second linkage end ball bearing coupler positioned in the second linkage end receptacle.

5. The self-contained reciprocation mechanism as defined in claim 1, further comprising:

a cylindrical sleeve positioned within the cylindrical passageway; and a cylindrical body positioned within the cylindrical sleeve, the cylindrical body configured to slidably receive the piston therethrough.

6. The self-contained reciprocation mechanism as defined in claim 5, wherein:

the cylindrical passageway includes a circumferential passageway channel defined along an inner surface of the cylindrical passageway;

the cylindrical sleeve includes a radially extending sleeve rim configured to be received by the circumferential passageway channel of the cylindrical passageway to prevent movement of the cylindrical sleeve along the longitudinal direction.

7. The self-contained reciprocation mechanism as defined in claim 6, wherein:

the cylindrical sleeve includes a circumferential sleeve channel defined along an inner surface of the cylindrical sleeve within the radially extending sleeve rim; and the cylindrical body includes a radially extending body rim configured to be received by the circumferential sleeve channel of the cylindrical sleeve to prevent movement of the cylindrical body along the longitudinal direction.

8. The self-contained reciprocation mechanism as defined in claim 6, wherein:

the circumferential passageway channel of the cylindrical passageway is positioned nearer to the middle portion of the spatial positioning bracket than to a free end of the semi-cylindrical end portion of the spatial positioning bracket.

9. The self-contained reciprocation mechanism as defined in claim 1, wherein:

the motor mounting portion of the spatial positioning bracket includes an upper motor mounting surface parallel with the longitudinal direction; and the spatial positioning bracket includes a plurality of mounting tabs, each of the plurality of mounting tabs including an upper mounting tab surface coplanar with the upper motor mounting surface, and a central mounting tab bore perpendicular to the longitudinal direction.

10. The self-contained reciprocation mechanism as defined in claim 9, wherein:

each of the plurality of mounting tabs is integrally formed as part of one or more of the motor mounting portion or the middle portion of the spatial positioning bracket.

11. The self-contained reciprocation mechanism as defined in claim 9, further comprising:

a plurality of rubber grommets, each positioned through the central mounting tab bore of a respective one of the plurality of mounting tabs, the plurality of rubber grommets configured to dampen vibrations from the motor to the enclosure of the percussive massage device when the self-contained reciprocation mechanism is coupled to the enclosure.

12. A battery-powered percussive massage applicator comprising:

a main enclosure including a first enclosure portion coupleable to a second enclosure portion, the main enclosure including a cavity defined between the first and second enclosure portions, the cavity at least extending along a longitudinal direction and including a front opening; and a reciprocation unit coupleable to one of the first enclosure portion or the second enclosure portion within the cavity, the reciprocation unit comprising:

a spatial positioning bracket including a motor mounting portion formed as a flat plate, a semi-cylindrical end portion, and a middle portion positioned between the motor mounting portion and the semi-cylindrical end portion, the semi-cylindrical end portion and the middle portion are each formed as a partial cylinder extending away from the motor mounting portion along a longitudinal direction, and the motor mounting portion, the middle portion, and the semi-cylindrical end portion form an integral unit;

a semi-cylindrical bracket coupleable to the semi-cylindrical end portion of the spatial positioning bracket to define a cylindrical passageway along the longitudinal direction;

a piston slidably positioned within the cylindrical passageway, the piston having a first piston end and a second piston end, the piston constrained to move only along the longitudinal direction through the cylindrical passageway, the piston configured to receive a removably attachable applicator head;

a motor coupled to the motor mounting portion of the spatial positioning bracket, the motor including a rotatable shaft extending through a central hole of the motor mounting portion, the shaft having a central axis oriented perpendicular to the longitudinal direction;

a crank coupled to the shaft of the motor, the crank including a post offset from and parallel to the central axis of the shaft and extending away from the motor mounting portion of the spatial positioning bracket; and a reciprocation linkage having a first linkage end and a second linkage end, the first linkage end coupled to the post of the crank, the second linkage end coupled to the first piston end.

13. The percussive massage applicator as defined in claim 12, wherein:

at least the second piston end is configured to extend outwardly from the front opening of the cavity.

14. The percussive massage applicator as defined in claim 12, wherein:

the spatial positioning bracket includes a plurality of mounting tabs, each of the plurality of mounting tabs including a central mounting tab bore perpendicular to the longitudinal direction; and the central mounting tab bore of each of the plurality of mounting tabs configured to receive a screw for coupling the spatial positioning bracket to one of the first enclosure portion or the second enclosure portion of the main enclosure within the cavity.

15. The percussive massage applicator as defined in claim 14, further comprising:

a plurality of rubber grommets, each positioned through the central mounting tab bore of a respective one of the plurality of mounting tabs, the plurality of rubber grommets configured to dampen vibrations from the motor to the main enclosure of the percussive massage applicator.

16. The percussive massage applicator as defined in claim 12, wherein:

the first linkage end includes a first linkage end upper surface, and the second linkage end includes a second linkage end upper surface positioned parallel to both the first linkage end upper surface and the longitudinal direction; and the second linkage end upper surface is offset above the first linkage end upper surface relative to the longitudinal direction.

17. The percussive massage applicator as defined in claim 16, wherein:

the motor mounting portion of the spatial positioning bracket is offset from the second linkage end upper surface in a direction perpendicular to the longitudinal direction.

18. The percussive massage applicator as defined in claim 12, further comprising:

a cylindrical sleeve positioned within the cylindrical passageway; and a cylindrical body positioned within the cylindrical sleeve, the cylindrical body configured to slidably receive the piston therethrough.

19. The percussive massage applicator as defined in claim 18, wherein:

the cylindrical passageway includes a circular passageway channel defined along an inner surface of the cylindrical passageway and configured to receive a radially extending sleeve rim of the cylindrical sleeve; and the cylindrical sleeve includes a circular sleeve channel defined along an inner surface of the cylindrical sleeve and aligned with the radially extending sleeve rim of the cylindrical sleeve, the circular sleeve channel of the cylindrical sleeve configured to receive a radially extending body rim of the cylindrical body.

20. The percussive massage applicator as defined in claim 18, wherein:

a distal end of the spatial positioning bracket opposite the motor mounting portion aligns with free ends of the cylindrical sleeve and the cylindrical body.

* * * * *